US005305698A

United States Patent [19]

Blackwell et al.

[11] Patent Number: 5,305,698

[45] Date of Patent: Apr. 26, 1994

[54] METHOD AND APPARATUS FOR IMPROVING FLUID FLOW AND GAS MIXING IN BOILERS

[76] Inventors: Brian R. Blackwell, 4680 W. 11th Avenue, Vancouver, B. C., Canada, V6R 2M7; Colin MacCallum, 1808 Duchess Avenue, West Vancouver, B. C., Canada, V7V 1R1

[21] Appl. No.: 887,764

[22] Filed: May 22, 1992

Related U.S. Application Data

[63] Continuation-in-part of Ser. No. 587,645, Sep. 24, 1990, Pat. No. 5,121,700, which is a continuation-in-part of Ser. No. 333,545, Apr. 4, 1989, abandoned.

[51] Int. Cl.[5] ..... F23L 1/00; F23L 9/00

[52] U.S. Cl. ..... 110/348; 110/297; 110/234

[58] Field of Search ..... 110/348, 297, 347, 234; 431/176, 180, 175

[56] References Cited

U.S. PATENT DOCUMENTS

| | | | |
|---|---|---|---|
| 1,473,665 | 11/1923 | Berthelon . | |
| 2,416,462 | 2/1947 | Wilcoxson . | |
| 2,730,997 | 1/1956 | Birkner . | |
| 3,048,131 | 8/1962 | Hardgrove . | |
| 3,920,377 | 11/1975 | Yanuki et al. | 431/176 X |
| 4,246,853 | 1/1981 | Mehta . | |
| 4,712,491 | 12/1987 | Schmidt . | |
| 4,744,312 | 5/1988 | Narisoko et al. . | |
| 4,785,744 | 11/1988 | Fontaine . | |
| 4,823,710 | 4/1989 | Garrido et al. . | |
| 5,007,354 | 4/1991 | Uppstu | 110/297 X |
| 5,022,331 | 6/1991 | Simonen | 110/297 |
| 5,139,414 | 8/1992 | Nakamoto et al. | 431/176 |

FOREIGN PATENT DOCUMENTS

| | | |
|---|---|---|
| 52838 | 7/1896 | Canada . |
| 81609 | 6/1903 | Canada . |
| 103734 | 2/1907 | Canada . |
| 123527 | 2/1910 | Canada . |
| 131367 | 6/1910 | Canada . |
| 160633 | 2/1915 | Canada . |
| 188641 | 12/1918 | Canada . |
| 197858 | 3/1920 | Canada . |
| 248658 | 4/1925 | Canada . |

(List continued on next page.)

OTHER PUBLICATIONS

Babcock & Wilcox, The World's Leading Recovery Boiler, Publication date unknown.

MacCallum, Colin and Blackwell, B. R., Modern Kraft Recovery Boiler Liquor-Spray and Air Systems, tech- (List continued on next page.)

*Primary Examiner*—Edward G. Favors

*Attorney, Agent, or Firm*—Chernoff, Vilhauer, McClung & Stenzel

[57] ABSTRACT

This invention is directed to a method and apparatus for improving fluid flow and gas mixing in boilers. More particularly, this invention pertains to a method and apparatus for improved fluid flow and gas mixing in kraft recovery boilers for increased energy efficiency, reduced TRS emissions and increased capacity. The method of introducing air into a boiler furnace comprises: (a) introducing air through at least one opening located on at least a first wall of the interior of the furnace; and (b) introducing air through at least one second opening located on a second wall of the interior of the furnace opposed to the first wall at the same, or slightly different, elevations. The method of introducing air into a boiler furnace may also comprise: (a) introducing air into the furnace in the form of a first set of small and large jets originating from one wall of the interior of the furnace; and (b) introducing air into the furnace in the form of a second set of small and large jets originating from the wall of the interior of the furnace opposite the first wall. The locations of the sources of the first set of small and large jets may be placed so that they oppose the sources of the second set of small and large jets, with small jets opposing large jets, and vice versa. The sizes of the jets may be regulated by varying opening size, number of openings in groups of openings, air pressure upstream of the openings, or combinations thereof.

65 Claims, 1 Drawing Sheet

FOREIGN PATENT DOCUMENTS

| | | |
|---|---|---|
| 399323 | 9/1941 | Canada . |
| 524931 | 5/1958 | Canada . |
| 1016415 | 8/1977 | Canada . |
| 1046853 | 1/1979 | Canada . |
| 1062964 | 9/1979 | Canada . |
| 1066136 | 11/1979 | Canada . |

OTHER PUBLICATIONS nical paper International Recovery Conference, New Orleans, 1985, pp. 1, 2, 25 and 26.

Arthur D. Little, Inc., Incinerator Overfire Mixing Study, Feb. 1972, pp. 1C, 1G, VI pp. 3-8.

Chapman, Paul J. and Jones, Andrew K., Recovery Boiler Secondary Air System Development Using Experimental and Computational Fluid Dynamics, Tappi Engineering Conference, Seattle, Sep. 1990.

Blackwell, Brian; Hambleton, Hugh and Brown, Ed, Two-Wall Primary Air in Kraft Recovery Boilers, Canadian Pulp and Paper Association Conference, Whistler, B. C., 1991.

Adams, T. N. & Frederick, W. J., Kraft Recovery Boiler Physical and Chemical Processes.

Babcock & Wilcox, Steam/Its Generation and Use, 1978.

Fridley M. W. & Barson, J. A. Upgrading the Combustion System of a 1956-Vintage Recovery Steam Generator, Tappi Journal, Mar. 1988.

Fridley, M. W., Mid America Packaging, Barsin, J. A. Upgrading a 1956 Vintage Recovery Steam Generator—II, 1988 Annual Meeting, Canadian Pulp and Paper Association.

METHOD AND APPARATUS FOR IMPROVING FLUID FLOW AND GAS MIXING IN BOILERS

This is a continuation-in-part of U.S. patent application Ser. No. 07/587,645, filed Sep. 24, 1990, U.S. Pat. No. 5,127,700 which was a continuation-in-part of U.S. patent application Ser. No. 07/333,545, filed Apr. 4, 1989, now abandoned.

FIELD OF THE INVENTION

This invention is directed to a method and apparatus for improving fluid flow and gas mixing in boilers. More particularly, this invention pertains to a method and apparatus for improved fluid flow and gas mixing in kraft recovery boilers for increased energy efficiency, decreased odorous TRS emissions and increased capacity to burn liquor from the pulping process.

BACKGROUND OF THE INVENTION

Boilers are widely used to generate steam for numerous applications. In the pulp and paper industries, recovery boilers are used to burn the liquor produced in a kraft pulp making process. Such boilers require combustion air. The current practice for introducing combustion air into the kraft recovery boilers involves injection of the air at two or more elevations in the furnace of the boiler. At the lowest elevation, air is injected through ports in all four walls. At higher elevations, air is injected through ports in all four walls or in two opposite walls of the furnace. The port openings from which the air jets issue are usually rectangular.

Conventional boiler systems have at least three basic deficiencies:

(1) In some cases, the jet port openings are so small that when upflowing combustion gases in the furnace come from below the openings, an individual jet stream coming from a port does not have enough momentum to enable the jet stream to reach the centre of the furnace before the jet is deflected upwards.

(2) The combustion air is usually injected in such a way that the jet streams of combustion air interfere with each other, and the interference causes upward deflection of the jet streams. Two locations where such interference can occur are at the centre of the furnace, where the jet streams from opposite walls of the furnace may meet head on, if they penetrate before being deflected upwards by the upward flowing furnace gases; and in the corners of the furnace, where the jet streams meet at right angles and interfere with one another.

(3) When jet streams meet head on and are directed upwards, they tend to be repelled somewhat such that there is an isolated space between their paths, and hence there is restricted mixing in these spaces.

Due to the lack of momentum of the jet streams and because of the interference between the jet streams, as described, gas in the centre of the furnace is directed sharply upwards with somewhat of a diverging pattern. The result is a central updraft core of high gas velocity relative to the average upward gas velocity at any one horizontal cross-section of the furnace. This central updraft core begins at the primary air level. The updraft core has associated with it a recirculating downflow by the furnace walls, which adds to the upward velocity of the gas in the centre of the furnace. It has been found that air jets located more than one to two meters above the primary air level have great difficulty penetrating this central updraft core. The chemical composition in this updraft core is unsuitable for thorough combustion because it contains a high concentration of combustibles and little oxygen for combustion.

The primary jets, located at the lowest elevation in the furnace, are the main factor in initiating the recirculating pattern and the adverse central updraft. In essentially all current recovery boiler designs, the primary air is introduced more or less equally through multiple openings in all four walls thereby forming a plane jet stream off each wall. These four plane jet streams meet in the central region of the furnace and rise together. As the jet streams issue from the ports, they entrain surrounding gases. Since the upflow of volatiles from the char bed of the furnace is limited in volume, gases are necessarily drawn down the furnace walls in order to continually replace the gases that are entrained into the upwardly flowing jet streams. This action sets up a recirculating flow pattern in the furnace.

In boilers which have only one air entry level below the liquor spray level, such as older Combustion Engineering-type (CE-type) boilers, the central updraft core has been found to occupy approximately 1/9 of the horizontal cross-sectional area in the lower furnace. This core extends up through the elevation where the liquor spray is introduced. The top of the recirculating pattern occurs some height above the liquor spray level in the boiler, at an elevation corresponding approximately to the uppermost level of air injection in such boilers-designated the tertiary air level for the purposes of this discussion. The air jets introduced at this upper air level have been found to have little influence on the recirculating pattern.

Most boilers with two levels of air entry below the liquor sprayers, such as older Babcock & Wilcox-type (B&W-type) boilers and the newer CE-type boilers, have primary and secondary air ports on all four walls, with the air at a given air level being introduced more or less equally on each wall. The introduction of secondary air more or less equally from all four walls in such boilers reinforces the detrimental central updraft core phenomenon.

One of the major operational problems in kraft recovery boilers is the formation of fireside deposits on the pendent heat transfer surfaces in the upper part of the boiler. The most troublesome deposits occur in the superheater and the first part of the boiler bank. These deposits are formed mainly by particles that originate from the gas entrainment of some of the liquor spray particles. The mass of a particle that can be entrained in a gas varies with about the sixth power of gas velocity. Therefore, from a conceptual perspective, it is important to minimize gas velocity extremes. As the liquor spray particles fall towards the bottom of the furnace, they swell and lose weight, becoming less dense, and therefore become easier to entrain. Therefore, the most sensitive area for entrainment is at the char bed/primary air entry level of the furnace. A second critical area is where there is a secondary level of air entry just above the char bed. Most of the particles that are entrained upwards into the region above the liquor spray level by the upwardly flowing gases are essentially destined to be carried out of the furnace by the furnace exit gas. Therefore, for the air introduced above the liquor spray level, upward gas velocity is not as much of a concern relative to minimizing fireside deposition.

Char bed control is a major operational concern with kraft recovery boilers. The char is formed as liquor spray particles burn in the furnace. The char is partially burned in flight, as it falls to the bottom of the furnace, but the last part of the carbon in the char is burned out on top of the char bed that covers the bottom of the furnace. One of the main functions of the primary air jets is to supply the oxygen to burn the char on the surface of the bed. The heterogeneous combustion of the char on the bed is limited by the mass transfer of oxygen, by diffusion. If the primary air jets are ineffective at supplying oxygen to the char, the bed grows in size. When this occurs, the boiler operator increases the temperature and/or pressure of the liquor in the spray guns, so that the liquor spray has smaller particles. With smaller particles more of the char is burned in flight so less has to be burned on the char bed. Increased liquor spray temperature, while it does control the char bed size, has the disadvantage that the smaller spray particles are easier to entrain by the upflowing furnace gases, resulting in an increase in the rate of formation of fireside deposits.

In one recovery boiler retrofit, designed by the inventors, some of the primary air ports were enlarged, to decrease the velocity of the primary air jets, with the intention of minimizing the scouring of char particles off the char bed by the primary air jets. Operating experience on the boiler after the retrofit indicated that low-velocity primary jets are somewhat impractical because they are not as effective at controlling char bed size and shape as high-velocity primary jets. The theory of low-velocity primary jets would be more practical if liquor spray guns produced particles essentially all one size. However, the guns produce a range of particle sizes, from fine to coarse. The large particles presumably cause the problems with control of char bed size. The fine particles are entrained by the furnace gases and are the source of the material that forms the fireside deposits on the heating surfaces in the upper part of the boiler. Both before and after the retrofit, a flat metal bar was inserted into the boiler, in the upper heating surfaces; on removing the bar after a short time, unburned black liquor spray particles were observed. Also, observations with the two char bed imaging cameras after the retrofit indicated that conditions in the lower furnace were quite quiet and there did not seem to be much carryover from the region just above the char bed. Nonetheless, the fireside deposits continued to form. These observations lead to the conclusion that the fine liquor spray particles were the dominant source of material for fireside deposits, rather than particles scoured off the char bed. Furthermore, the fine liquor spray particles seemed to be carried directly upwards. With the low-velocity primary jets, char bed control deteriorated, so higher liquor spray temperatures were required to compensate. Higher liquor temperature caused more fine spray particles and therefore more direct carryover from the liquor spray level. Subsequent to this, the enlarged primary ports were dampered off, thereby forcing some of the air to the remaining smaller primary ports. This increased the velocity of the air jets from the primary ports remaining open. With the increased velocity of the primary jets, char bed control improved, allowing the liquor temperature to be decreased. In retrospect, the enlarged primary ports were a conceptual error. Rather, it would have been better to use high-velocity primary jets to control the char bed size, thereby allowing a lower liquor temperature and pressure which would generate fewer finer particles, and in turn decrease carryover. Therefore, while low primary jet velocities are indicated theoretically, practical considerations of char bed control make high velocity primary jets more beneficial overall.

Secondary air is provided above the char bed. The function of these air jets is to provide oxygen for the combustion of the volatiles such as carbon monoxide and hydrogen gasified from the liquor spray particles. Here the main concern is to provide the necessary mixing of the combustible gases and the air, while minimizing upward gas velocity extremes that aggravate the entrainment of liquor spray particles. These jets are not intended to impinge on the char bed, so they do not have a direct char bed control function. Therefore, low velocity may be indicated for the secondary air jets.

U.S. Pat. No. 2,416,462 Wilcoxson, discloses a concept involving an interlacing pattern of unopposed jets at the tertiary air level of a furnace (above the liquor sprayers) but it appears such interlacing was done without full appreciation as to the effects of interlacing. No interlacing at the primary and secondary levels of the boiler is disclosed. No partial interlacing of air jets, wherein larger jets oppose smaller jets, is disclosed. Also, the concept of two-wall primary air is not disclosed.

Fridley and Barsin [Fridley, M. W. and Barsin, J. A., "Upgrading the Combustion System of a 1956 Vintage Recovery Steam Generator", Tappi Journal , March, 1988, page 63 and Fridley, M. W. and Barsin, J. A., "Upgrading a 1956 Vintage Recovery Steam Generator-II", Technical Section, Canadian Pulp and Paper Industry, 1988 Annual Meeting , Montreal] described modifications to an older CE-type boiler in 1986, to implement fully interlaced, unopposed, air jets at the secondary level, below the liquor spray level. There was an improvement in boiler performance. They claimed a decrease in liquor spray carryover. Recent B & W designs of recovery boiler air systems also incorporate this full interlacing of air jets at the secondary level. None of these designs incorporate the concept of partially interlaced air jets wherein larger jets oppose smaller jets. None of these designs incorporate two-wall primary air.

For the purposes of the following discussion, it should be noted that air jets issuing from a group or cluster of closely spaced ports will combine to form a single jet somewhat larger than each of the individual jets.

SUMMARY OF THE INVENTION

A method of introducing primary air at the lowest airflow elevation into a kraft recovery boiler furnace having four walls, said method comprising: (a) introducing air using a first set of jets located at the lowest elevation on a first wall of the interior of the boiler furnace; (b) introducing air substantially at said lowest elevation using a second set of jets located on a second wall of the interior of the boiler furnace opposed to the first wall; and (c) substantially no air being introduced at substantially said lowest elevation through the remaining walls.

In the invention as described, air can be introduced into the furnace using sets of jets originating from the first and second opposing walls with approximately the same air flow rate from each wall.

A method of introducing primary air at the lowest airflow elevation into a kraft recovery boiler furnace comprising: (a) introducing air into the furnace at the lowest air flow elevation by means of a first set of large jets originating from a first wall of the interior of the furnace; (b) introducing air into the furnace by means of a second set of large jets originating from a second wall of the interior of the furnace opposite the first wall and substantially at the same elevation as the first set of jets; and (c) introducing air into the furnace by means of a third set of small jets originating from a third wall of the interior of the furnace between the first wall and the second wall, at substantially the same elevation as the first and second sets of jets.

In the method described, air may be introduced into the furnace using large jets originating from the first and second opposing walls with approximately the same air flow rate from each wall, and air is introduced into the furnace using small jets originating from the third wall of the furnace at a flow rate lower than the flow rate of air in the jets originating from the first and second walls.

A method of introducing primary air at the lowest airflow elevation into a kraft recovery boiler furnace comprising: (a) introducing air into the furnace at the lowest air flow elevation by means of a first set of large jets originating from a first wall of the interior of the furnace; (b) introducing air into the furnace by means of a second set of large jets originating from a second wall of the interior of the furnace opposite the first wall and substantially at the same elevation as the first set of jets; (c) introducing air into the furnace by means of a third set of small jets originating from a third wall of the interior of the furnace between the first wall and the second wall, at substantially the same elevation as the first and second sets of jets; and (d) introducing air into the furnace by means of a fourth set of small jets originating from a fourth wall of the interior of the furnace between the first wall and the second wall, opposite the third wall, at substantially the same elevation as the first, second and third sets of jets.

In the method described, air may be introduced into the furnace using large jets originating from the first and second opposing walls with approximately the same air flow rate from each wall, and air may be introduced into the furnace using small jets originating from the third and fourth opposing walls of the furnace with flow rates from the third and fourth walls lower than the flow rate of air in the jets originating from the first and second walls.

In the method: (a) secondary air may be introduced using another first set of jets located at an elevation higher than the lowest elevation on said first wall of the interior of the boiler furnace; (b) secondary air may be introduced using another second set of jets located on said second wall of the interior of the boiler furnace opposed to said first wall substantially at said elevation higher than the lowest elevation; and (c) substantially no secondary air may be introduced through the remaining walls substantially at said elevation higher than the lowest elevation.

In the method described: (a) secondary air can be introduced using another first set of jets located at an elevation higher than the lowest elevation on said first wall of the interior of the furnace; (b) secondary air can be introduced using another second set of jets located on said second wall of the interior of the boiler furnace opposed to said first wall substantially at said elevation higher than the lowest elevation with approximately the same flow rate of secondary air from the said first and second walls; and (c) secondary air can be introduced substantially at said elevation higher than the lowest elevation using sets of jets located on said third and fourth walls of the interior of the furnace, between the first and second walls, the flow of secondary air through the third and fourth walls being less than the flow of secondary air through the first and second walls.

In the method described, the small and large jets can originate from corresponding single small and large ports located in the respective furnace walls. Each small jet can be formed by a combination of jets originating from a first group of closely spaced small ports located in the respective furnace wall and each large jet can be formed by a combination of jets originating from a second group of closely spaced large ports of similar number to the first group located in the respective furnace wall.

In the method described, the small and large jets can originate from ports that are of similar size and each large jet can be formed by a combination of jets originating from a larger group of closely spaced ports than does each of the small jets.

In the method, the large and small jets can originate from single ports of similar size and the large jets can be created by air pressure at a higher level behind the respective ports compared with the air pressure behind the respective ports used to create the small jets. Each jet can be formed by a combination of jets originating from a group of closely spaced ports similar in size and number and the large jets can be created by air pressure at a higher level behind the ports compared with the air pressure behind the ports used to create the small jets.

Each jet can be formed by a combination of jets issuing from a cluster of closely spaced ports with some of the ports in each cluster being at one elevation and the other ports at one or more slightly different elevations.

A kraft recovery boiler furnace which utilizes injected air comprising: (a) a furnace chamber having four walls; (b) a first set of ports located at the lowest elevation on a first wall of the interior of the furnace; (c) a second set of ports located at the lowest elevation on a second wall of the interior of the furnace opposite the first wall; and (d) no ports located at the lowest elevation on a third wall or a fourth wall, each being respectively located between the first and second walls.

A kraft recovery boiler furnace according to claim 19 wherein: (d) a third set of small ports are located at the lowest elevation on a third wall of the interior of the furnace, between the first and second wall; and (e) no ports are located at the lowest elevation on a fourth wall of the interior of the furnace opposite to the third wall.

Alternatively, the kraft recovery boiler furnace can have: (d) a third set of small ports located at the lowest elevation on a third wall of the interior of the furnace, between the first and second wall; and (e) a fourth set of small ports located at the lowest elevation on a fourth wall of the interior of the furnace opposite to the third wall.

Further, the kraft recovery boiler furnace can have: (d) a third set of similarly sized ports located at the lowest elevation on a third wall of the interior of the furnace, between the first and second wall; (e) a fourth set of similarly sized ports located at the lowest elevation on a fourth wall of the interior of the furnace opposite to the third wall; and (f) a set of devices associated with the ports on all four walls, for restricting the flow of air in the ports, said devices being operated such that the flow of air through the third and fourth sets of ports is less than the flow of air through the first and second sets of ports, or substantially zero.

In the kraft recovery boiler furnace as described: (e) another first set of ports can be located on said first wall of the interior of the furnace at an elevation above the lowest elevation; (f) another second set of ports can be located on said second wall of the interior of the furnace at an elevation above the lowest elevation and at substantially the same elevation as said another first set of ports; and (g) no ports can be located on the third and fourth walls at substantially the elevation where said another first set of ports and said another second set of ports are located.

A kraft recovery boiler furnace as described wherein: (e) sets of ports can be located on all four walls of the interior of the furnace at an elevation above the lowest elevation; and (f) devices can be associated with the ports on all four walls substantially at an elevation above said lowest elevation, for restricting the flow of air in the ports at said elevation above the lowest elevation, said devices being operated such that the flow of air through the third and fourth sets of ports is less than the flow of air through the first and second sets of ports, or substantially zero.

In the kraft recovery boiler furnace described, the ports can be of similar size.

A method of introducing air at any elevation into a boiler furnace comprising: (a) introducing air into the furnace by means of a first set of one or more small jets and one or more large jets originating from one wall of the interior of the furnace; and (b) introducing air into the furnace by means of a second set of one or more small jets and one or more large jets originating from a second wall of the interior of the furnace opposite the first wall and substantially at the same elevation as the first set of jets.

In the method described, the positions of the jets in the first set can be arranged so that a small jet originating from the first wall substantially opposes a large jet originating from the opposite wall and a large jet originating from the first wall substantially opposes a small jet originating from the opposite wall. The small and large jets of the first set can alternate with one another and the small and large jets of the second set can alternate with one another. The small and large jets can originate from corresponding small and large ports located in the furnace wall. Each small jet can be formed by a combination of jets from a first group of closely spaced small ports located in the furnace wall and each large jet can be formed by a combination of jets from a second group of closely spaced large ports of similar number or of a different number to the first group located in the furnace wall.

In the method as described, all the ports can be of similar size and each jet can be formed by a combination of jets from a group of closely spaced ports and each large jet can be formed by a larger group of closely spaced ports than the group forming the small jets. All the ports can be of similar size and each of the large jets can be formed by a combination of jets from a pair of closely spaced ports and each of the small jets can originate from a single port. Some or all of the area of the single port can be substantially opposite to at least some of the area defined by the pair of ports. Some or all of the area of the single port can be opposite the area defined by the pair of ports.

In the method described, each jet can issue from a cluster of closely spaced ports with some of the ports in each cluster being at one elevation and the other ports in the cluster at one or more slightly different elevations.

In the method described, with the large and small jets opposing one another, the boiler can be a kraft recovery boiler, or a biomass fired boiler.

In the method described, the flow of air which is introduced into the furnace at a specific elevation can be distributed approximately equally between the two opposed walls.

In the method described, an arrangement of jets originating from the third and fourth walls of the furnace at substantially the same elevation as the first and second set of jets can be included, and the air that is introduced to the furnace at said elevation can be distributed so that most of the air is distributed in substantially equal portions through the first and second walls, and a small portion of air is distributed substantially equally through the third and fourth walls.

A boiler furnace which utilizes injected air comprising: (a) a furnace chamber; (b) a first set of similarly sized ports located on one wall of the interior of the furnace; and (c) a second set of ports located on the wall of the interior of the furnace opposite the first wall, said ports in the second set being of size and number similar to the first set of ports, said ports in each set being arranged in large and small groups of closely spaced ports and, wherein groups of a greater number of closely spaced ports on each wall oppose groups of a fewer number of closely spaced ports on the opposite wall.

A furnace as described, wherein the groups of greater and fewer number ports in the first set are arranged in an alternating pattern and the groups of greater and fewer number ports in the second set are arranged in an alternating pattern.

DRAWINGS

In the drawings which illustrate specific embodiments of the invention but which should not be construed as restricting the spirit or scope of the invention in any way:

FIG. 1*a* illustrates a plan view of a conventional boiler furnace at the primary air level with jet interference arising from air injected below the liquor spray level from all four walls of the furnace, at the same elevation.

FIG. 1*b* illustrates a side view of the lower furnace of a conventional boiler with jet stream trajectories, that form a chimney flow pattern for the air introduced at the same elevation as in FIG. 1*a*, in this case with no secondary air, and tertiary air introduced tangentially above the liquor spray level.

FIG. 2*a* illustrates a plan view of a conventional boiler furnace with four-wall air introduction, below the liquor spray level.

FIG. 2*b* illustrates a side view of the lower furnace of a conventional boiler with air introduction from four walls at both the primary and secondary levels, below the liquor spray level, creating a chimney flow pattern with a central updraft, and with tertiary air introduced above the liquor spray level.

FIG. 3*a* illustrates air velocity measurements on a horizontal grid at the liquor spray level in 1/12th scale physical flow model of a traditional Combustion Engineering-type recovery boiler, having just one level of air below the liquor spray level, where the primary air is introduced from all four walls of the furnace.

FIG. 3*b* illustrates a graphical depiction of measurements of air velocity extremes distribution at the liquor spray level of a 1/12th scale physical flow model of a traditional Combustion-Engineering-type recovery boiler, where the primary air is introduced off all four walls of the furnace.

FIG. 4 illustrates a plan view of an improved situation involving an enlarged central updraft core in the lower furnace of a boiler, created by air introduction from two opposite walls, using fully (equally) opposed jets.

FIG. 5*a* illustrates a plan view of the jet stream pattern in a boiler furnace created by fully interlacing (unopposed) jet streams originating from opposing walls.

FIG. 5*b* illustrates a side view of the jet stream pattern in a boiler furnace created by fully interlaced (unopposed) jet streams.

FIG. 6*a* illustrates air velocity measurements on a horizontal grid at the liquor spray level in the physical flow model, with an added second level of air below the liquor spray level, operated with secondary jets originating from the front and rear walls in fully interlaced (unopposed) fashion.

FIG. 6*b* illustrates a graphical depiction of measurements of air velocity extremes distribution at the liquor spray level of the 1/12th scale physical flow model, with an added second level of air below the liquor spray level, operated with the secondary jets originating from the front and rear walls, in fully interlaced (unopposed) fashion.

FIG. 7 illustrates a plan view of the jet stream pattern in a boiler furnace with partially interlacing jet streams (unequally opposed jets) originating from opposing furnace walls.

FIG. 8*a* illustrates air velocity measurements on a horizontal grid at the liquor spray level in the physical flow model, with an added level of secondary air below the liquor spray, operated with secondary jets originating from the front and rear walls in a partially interlaced fashion, using unequally opposed jets.

FIG. 8*b* illustrates a graphical depiction of measurements of air velocity extremes distribution at the liquor spray level in the 1/12th scale physical flow model with an added level of secondary air below the liquor spray, operated with secondary jets originating from the front and rear walls in a partially interlaced fashion, using unequally opposed jets.

FIG. 9*a* illustrates a plan view of the jet stream pattern in a boiler furnace with partially interlaced jet streams at a lower air level originating from one pair of opposing walls.

FIG. 9*b* illustrates a plan view of the jet stream pattern in a boiler furnace with partially interlaced jet streams at an adjacent upper air level originating from the other pair of opposing walls (compared to FIG. 9*a*).

FIG. 10 illustrates a plan view of the jet stream pattern in a boiler furnace with partially interlacing jet streams, based on a register effect, in which several adjacent small jets combine to form a single larger jet.

FIGS. 11*a*, 11*b*, 11*c* and 11*d* illustrate the air port layout utilizing partially and totally interlacing jet streams in one recovery boiler by showing two plan section views of the primary elevation in the furnace, a plan view of the secondary level and a plan view of the tertiary level. At the primary and secondary levels, most of the jets are formed by the combination of smaller jets from closely grouped ports.

DETAILED DESCRIPTION OF A SPECIFIC EMBODIMENT OF THE INVENTION

Figure 1A:
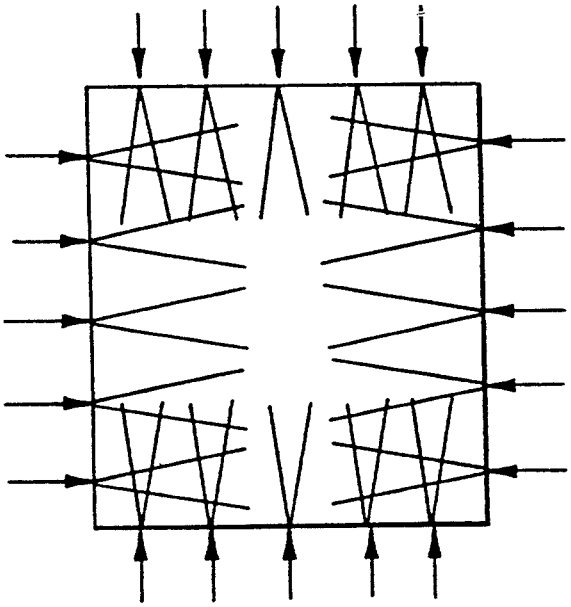
Figure 1B:
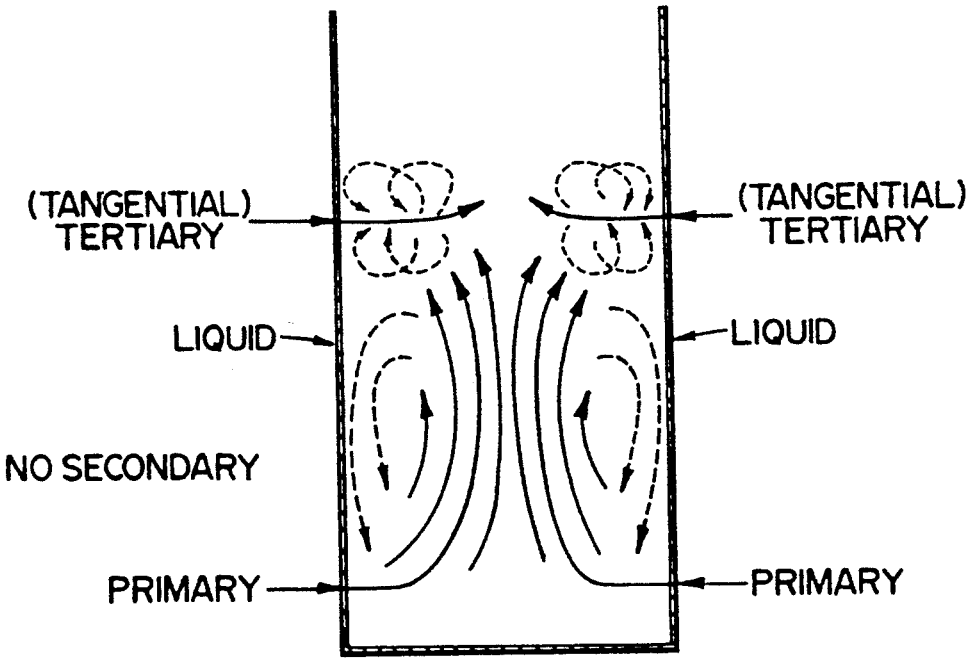
Figure 2A:
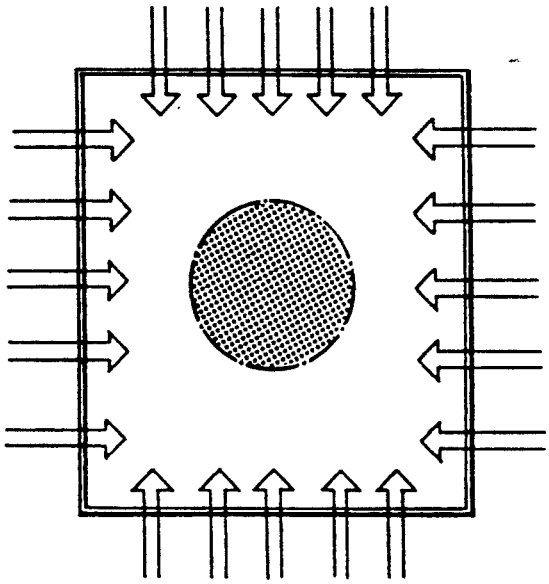
Figure 2B:
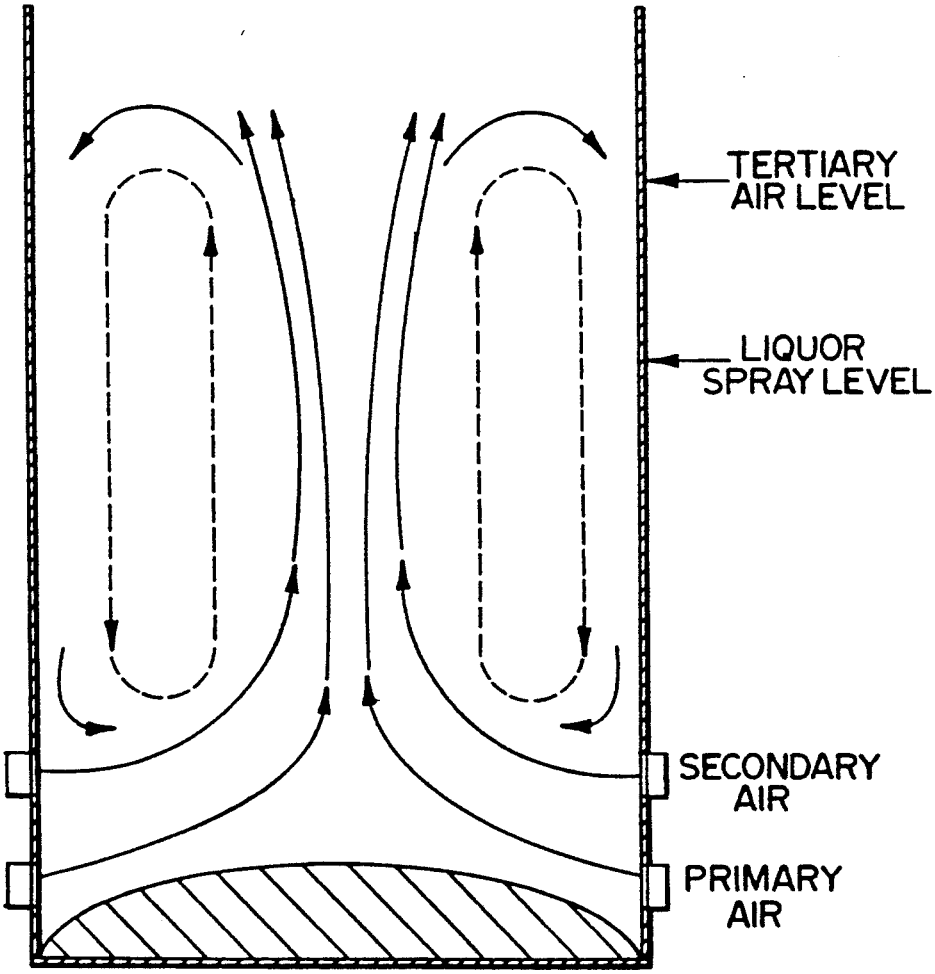
Figure 3A:
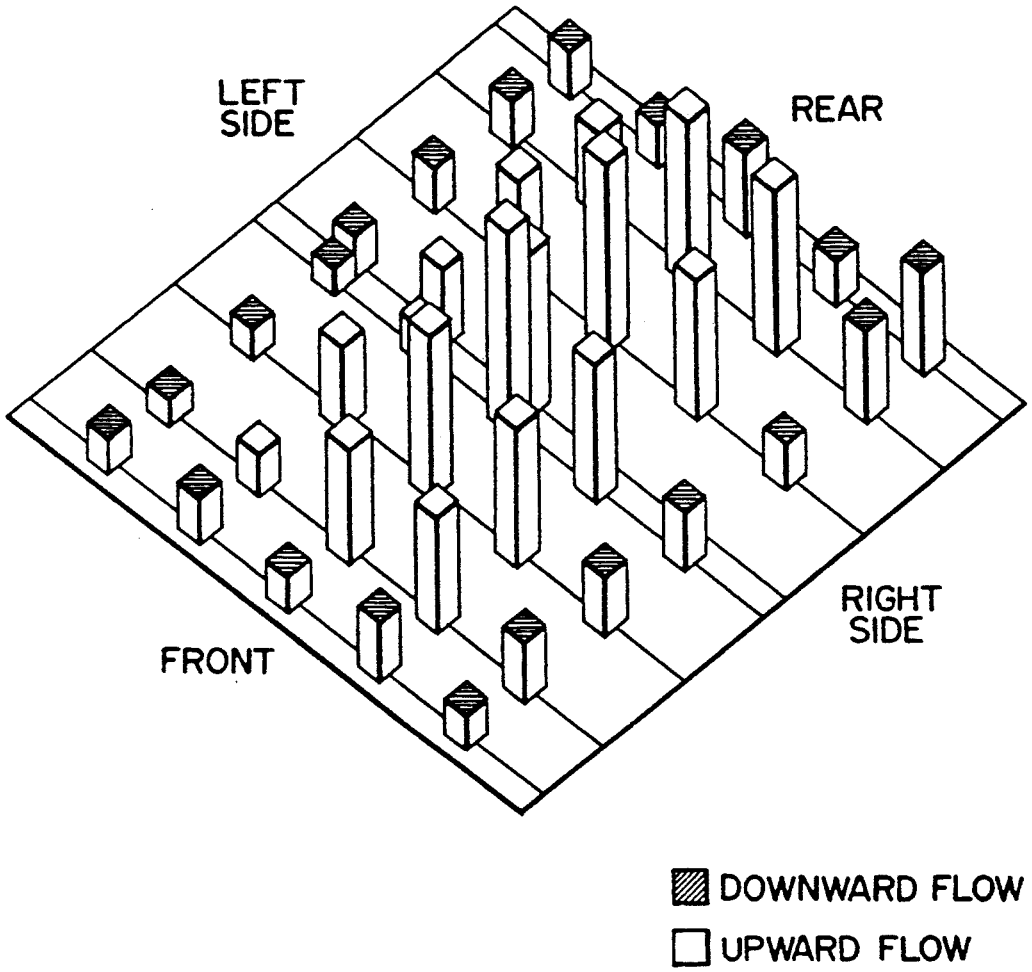
Figure 3B:
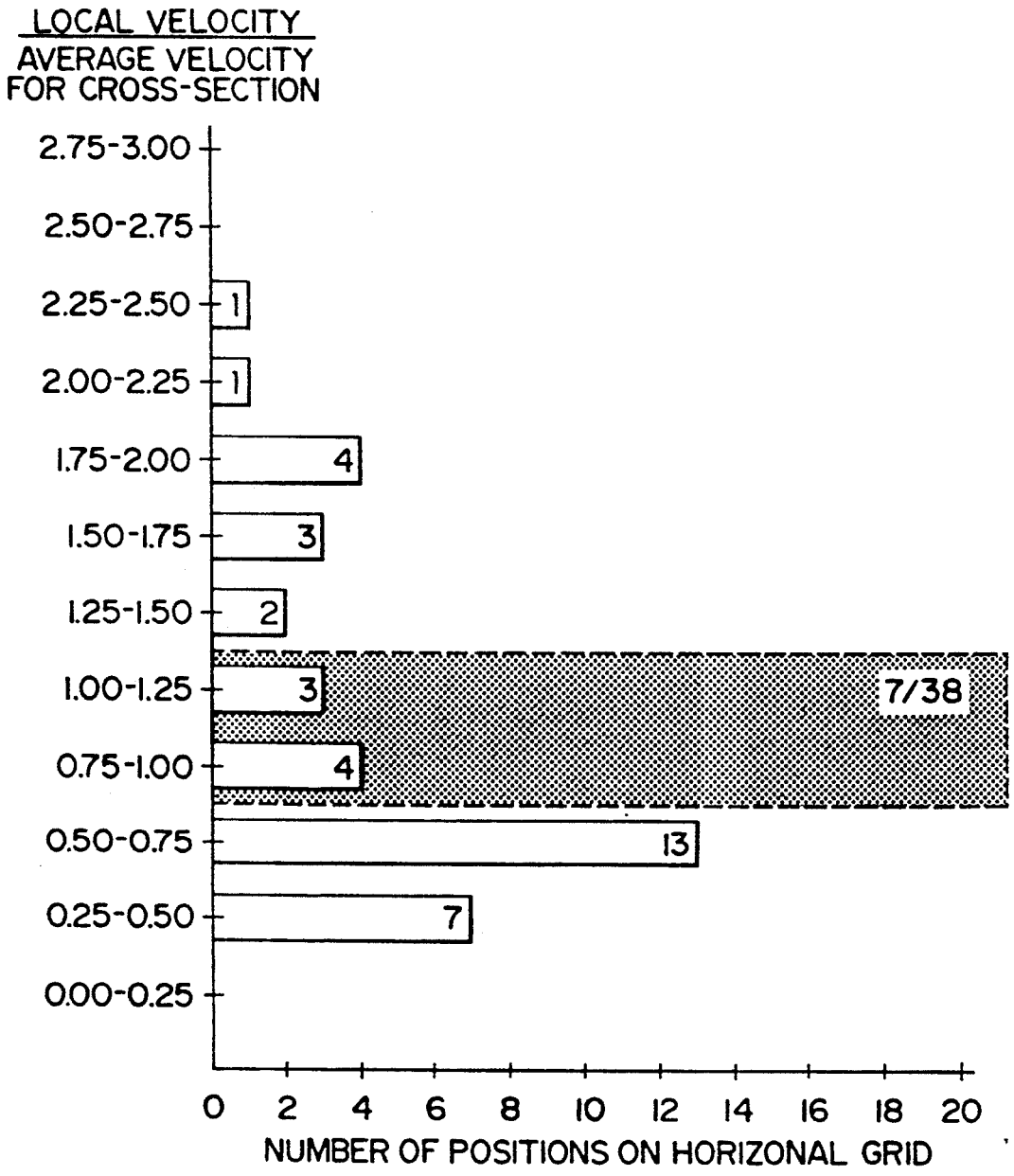
Figure 4:
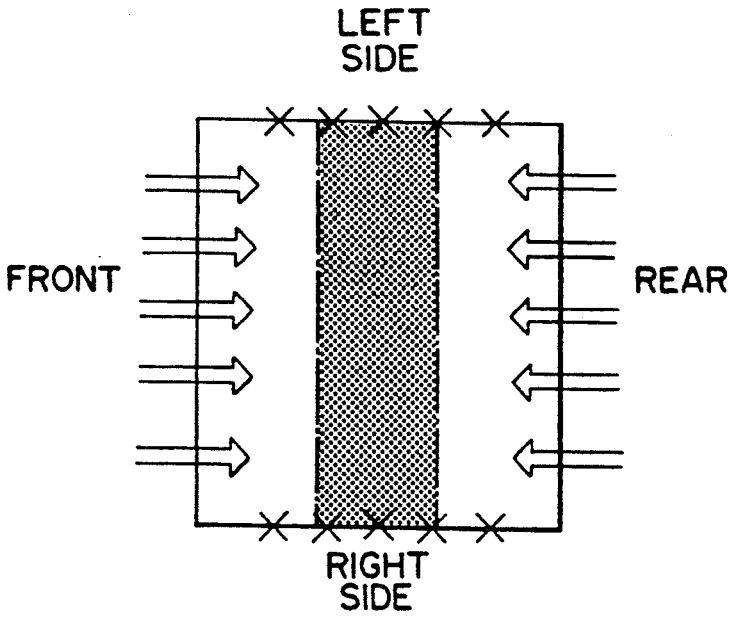

FIGS. 1*a*, 1*b*, 2*a* and 2*b* depict the detrimental recirculation and central core updraft circulation patterns that exist in conventional boilers. Supporting air velocity data obtained in a 1/12th scale physical flow model are shown in FIGS. 3*a* and 3*b*. For the data in FIGS. 3*a* and 3*b*, the model was operated with two air levels: primary air, equivalent to about 75% of the total air flow, coming equally from all four walls; and 25% of the total air introduced tangentially above the liquor spray level. A similar velocity profile was measured at the liquor spray level in the actual recovery boiler itself during special cold flow testing.

The inventors have taken two approaches to reduce gas velocity extremes and thereby reduce gas entrainment of liquor spray particles.

First, the air is introduced in such a manner as to create a gross gas flow pattern in the furnace that avoids or minimizes the adverse central updraft core and any recirculation pattern. In the ideal case, the upflowing gases should be evenly distributed across the entire furnace horizontal cross-sectional area and the recirculation of gases from an upper region of the furnace to the bottom should be eliminated. In other words, plug flow upwards is the ideal case.

Secondly, the secondary air is introduced into the furnace through as much port area as practically possible. This minimizes the velocities in the jets themselves while maintaining adequate jet stream momentum for good penetration. In this disclosure, the terms jet and jet stream are used interchangeably and refer to the stream of gas, which is generally combustion air, that is emitted through the plane of the furnace wall through a specific opening (a port) or may be formed by the combination of smaller jets originating from a group of openings.

The inventors have invented several ways to minimize velocity extremes in the bulk upflow of gases in the furnace.

Fully Opposed Primary Jets, on Two Opposite Walls (Two-wall Primary Air)

Figure 12:
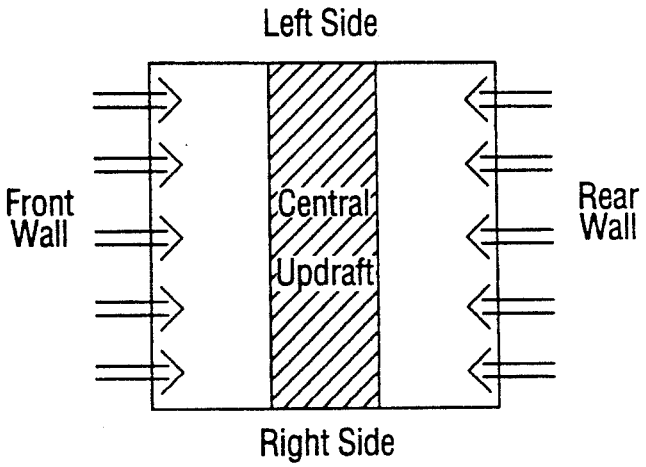
FIG. 12 is a plan view illustrating two wall primary air with completely opposed jets from two opposite walls only, at the primary air level.

A first level of improvement can be achieved by using air ports on two opposite furnace walls only, preferably the front and rear walls. This system is claimed by the inventors. A system along these lines is illustrated in FIG. 12. In this case, the jets originate from the front and rear walls, with no air from the left and right side walls. Alternatively, the jets may originate from the left and right side walls, with no air from the front and rear walls. This is referred to herein as Fully Opposed Primary Jets on Two Opposite Walls or, Two-wall Primary Air. In this way, air is not introduced at right angles from the other two walls, at a given furnace elevation, and does not interfere with these first jets. Typically, in this invention, primary air is introduced on the front and rear walls only, with no primary air being introduced from the side walls. Alternatively, the primary air may be introduced through the left and right side walls only, with no air from the front and rear walls. While this arrangement still produces a central updraft core, and a recirculating gas pattern with downflow adjacent to the front and rear walls, the area of the central updraft core is enlarged to occupy about ⅓ of the cross-sectional area instead of the normal 1/9 common with conventional four-wall primary operation. This increase in the area of the updraft core reduces the upward gas velocities in the central area of the furnace because more area is available for gas updraft.

Figure 15:
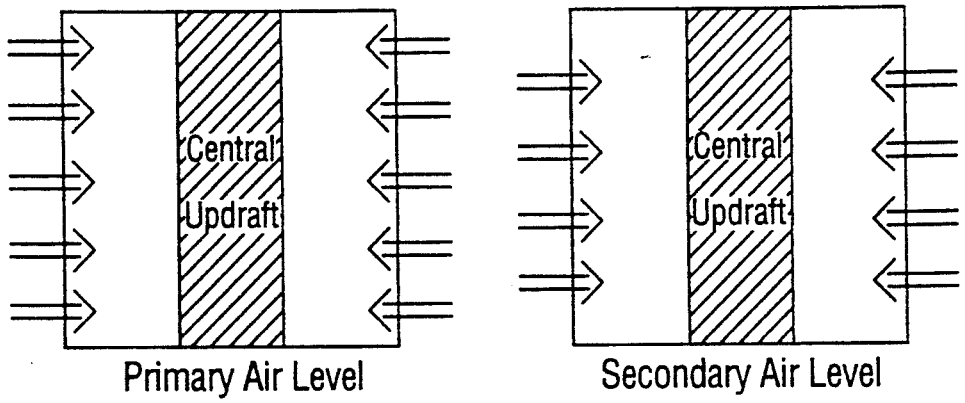
FIG. 15 is a plan view at the primary air level on the left and a plan view at the secondary air level on the right, illustrating two wall primary air with fully opposed secondary air.

This invention is applicable to any kraft recovery boiler, irrespective of the number of air levels above the primary level. However, it is particularly effective on boilers with only one level of air in the lower furnace below the liquor guns. In new recovery boilers, the concept of fully opposed primary jets, on two opposite walls could be implemented by installing primary air ports on two opposite walls only, with no primary air ports on the third and fourth walls, as shown in FIGS. 12 and 15. There are air ports at the primary level on two opposed walls only. At the secondary level, there are air ports on two opposed walls only, the same two walls as at the primary level.

In existing boilers having primary air ports on all four walls, the approach can be implemented simply by closing the dampers in the registers ahead of the primary ports on two opposite walls, preferably on the side walls. This approach has the additional advantage that the air velocity from existing primary ports in the front and rear walls of the furnace must approximately double, thereby improving char bed control. Better char bed control allows the liquor spray temperature and/or pressure to be decreased, so that the liquor spray has generally larger particles. With generally larger spray particles, fewer of the finer particles are entrained. Granted, with the increased velocity of the primary jets, there is an increased tendency to scour particles off the char bed. However, recovery boiler experience discussed earlier indicated that particles scoured off the char bed are not the dominant source of material for fireside deposits; fine liquor spray particles are the dominant source. Entrainment of fine liquor spray particles is decreased by both the lower liquor spray temperature allowed by better char bed control, and by the reduced upward velocities in the central updraft core provided by the enlarged cross-sectional area of the central updraft core. The observed net result is an overall decrease in the entrainment of liquor spray particles.

Figure 14:
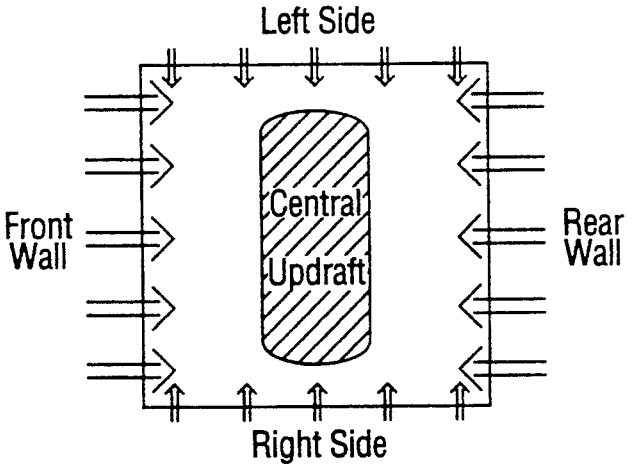
FIG. 14 is a plan view illustrating another variation of two wall primary air with completely opposed jets from two opposite walls, at the primary air level, with a small amount of air from the third and fourth walls.
Figure 16:
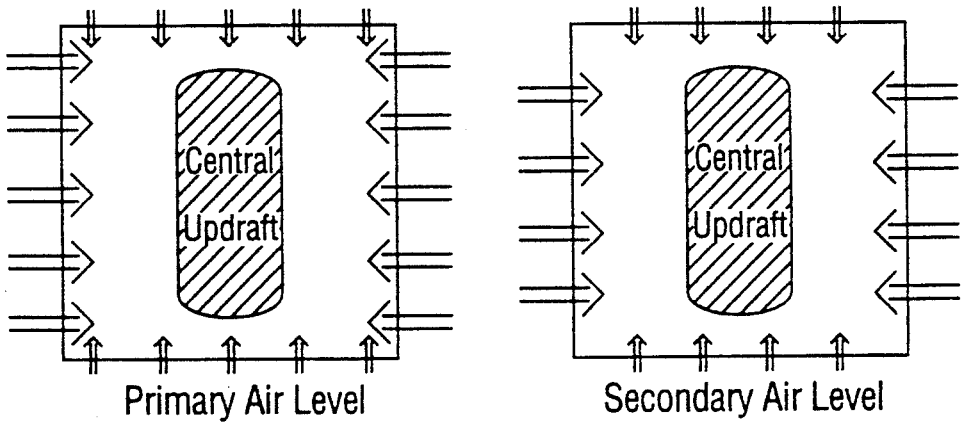
FIG. 16 is a plan view at the primary air level on the left and a plan view at the secondary air level on the right, illustrating two wall primary air with fully opposed secondary air, with small amounts of air from ports on the other two walls, at both primary air level and secondary air level.
Figure 17:
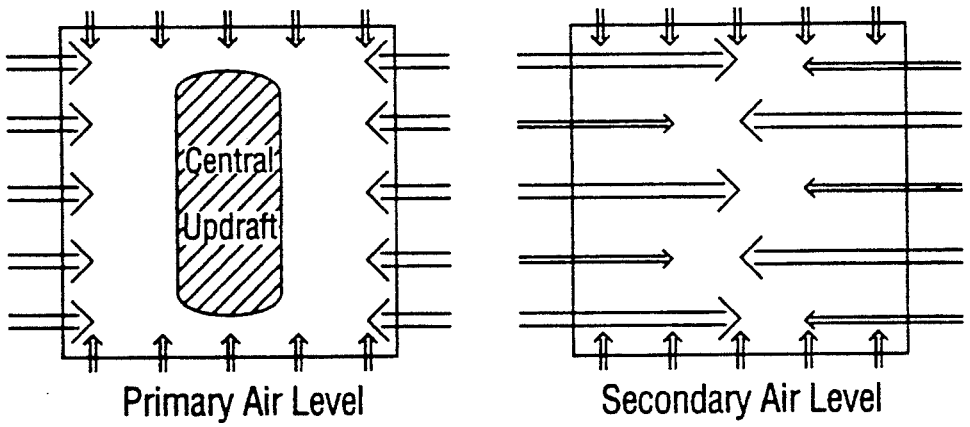
FIG. 17 is a plan view at the primary air level on the left and a plan view at the secondary air level on the right, illustrating two wall primary air with partially-interlaced secondary air, with small amounts of air from ports on the other two walls, at both primary air level and secondary air level.

When implementing fully opposed primary jets, on two opposite walls, on existing boilers having primary air ports on all four walls, by closing the dampers in the registers ahead of the primary ports on two opposite walls, some air leaks through the closed dampers. Consequently, most of the primary air flow comes through the ports in two walls where the dampers are open, while a minor portion of the total primary air flow comes through the ports in the other two walls where the dampers are closed. This is illustrated in FIGS. 14, 16 and 17. In this case, most of the primary air comes from the front and rear walls, with a small amount of air from the right and left side walls. Alternatively, most of the primary air can come from the left and right walls, with a small amount of air from the front and rear walls. At the primary level, most of the primary air originates from two opposed walls. Similarly, at the secondary level, most of the air originates from two opposed walls, the same two walls that most of the primary air originates from. At the primary level, most of the primary air originates from two opposed walls. Similarly, at the secondary level, most of the air originates from two opposed walls. These may be the same two walls that most of the primary air originates from as shown, or the other two walls.

The system of fully opposed primary jets, on two opposite walls can be implemented partially, by injecting a greater amount of the primary air through one set of two opposing walls, for example, the front and rear walls, and injecting a lesser amount through the other set of opposing walls, for example, the left and right side walls. This is also illustrated in FIGS. 14, 16 and 17.

Figure 13:
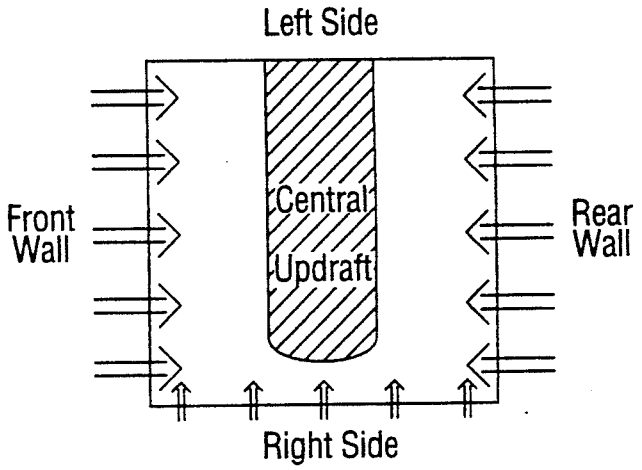
FIG. 13 is a plan view illustrating a variation of two wall primary air with completely opposed jets at two opposite walls, at the primary air level, with a small amount of air from a third wall.

In implementing two-wall primary air, the air flow coming from opposite walls would be approximately equal. For example, in a new boiler design with primary air ports on two walls only, the total primary air flow would be split so that approximately half of it would flow through the ports on each wall. This is shown in FIGS. 12 and 15. In an existing boiler, with primary ports on all four walls, most of the total primary air flow would originate from two opposite walls, in relatively equal portions, while the balance of the primary air flow would originate from the other two opposite walls in relatively equal portions. This is shown in FIGS. 14, 16 and 17. In some cases involving lesser quantities of air from the third and fourth walls, there are advantages to having more air flow from one of the third or fourth walls compared to the opposite wall. This is shown in FIG. 13. In this case, with most of the primary air from the front and rear walls as shown, a small amount of air can come either from the right side wall with no air from the left side wall as shown, or from the left side wall with no air from the right side wall. Alternatively, most of the primary air can come from the left and right side walls, and a small amount of air can come either from the front wall with no air from the rear wall, or from the rear wall with no air from the front wall.

On a boiler with two levels of air in the lower furnace below the liquor spray, the two-wall primary air concept would be best implemented by restricting the secondary air in the same way as the primary air; for instance, if all of the primary air, or most of it, comes from the front and rear walls, then all the secondary air, or most of it, should come from the front and rear walls. This is shown in FIGS. 15, 16 and 17. However, with the partially interlaced jets at the secondary level, as shown in FIG. 17, it is less important that the dominant walls for air flow at the secondary level be the same as at the primary level.

The concept of fully opposed primary jets, on two opposite walls, has been successfully tested on four operating boilers: having one level of air below the liquor spray level: twenty months of trials on one boiler, a five-week trial on one boiler and a two-day trial on two other boilers. The image on the char bed TV camera was brighter, especially in the centre of the bed, indicating higher temperatures. The char bed was flatter and easier to control, allowing an approximate 1° F. decrease in liquor spray temperature (significant) for the same char bed size. In the twenty months of trials on the one boiler, the rate of pluggage of the pendent heating surfaces decreased, indicating a decrease in the carryover of liquor spray particles. Measurements with a pyrometer indicated a 60° C. temperature increase in the gas above the char bed. This suggests better mixing of the combustion air and combustible gases in the lower furnaces. No operational problems of concern were observed in any of the trials.

Full Interlacing (Unopposed Jets)

Figure 5A:
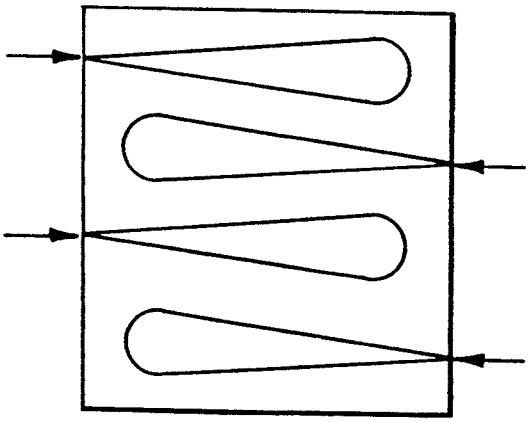
Figure 5B:
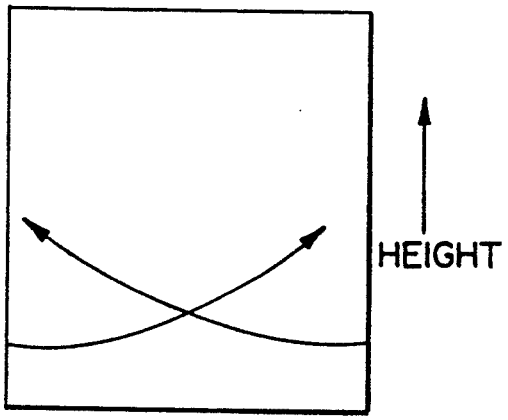

Some level of improvement can be obtained relative to conventional practice by utilizing a jet interlacing pattern. Such a pattern is depicted in FIGS. 5*a* and 5*b*. FIG. 5*a* illustrates a plan view of the jet stream pattern in a boiler furnace created by fully interlacing (unopposed) jet streams originating from opposing walls. FIG. 5*b* illustrates a side view of the jet stream pattern in a boiler furnace created by fully interlaced (unopposed) jet streams. This pattern is not claimed by the inventors. In this arrangement, the ports are located on two opposing walls of the furnace, but the ports on the two opposing walls are offset so that the opposing jet streams interlace fully without direct opposition and do not interfere with each other head-on. Wilcoxson, U.S. Pat. No. 2,416,462, discloses a concept involving interlacing at the tertiary air level of the furnace, above the liquor spray level. Wilcoxson did not optimize the pattern at the tertiary level and did not apply it to the primary and secondary levels of the furnace below the liquor spray. Fridley and Barsin, referred to earlier, disclose full interlacing at the tertiary level as well as the secondary level, below the liquor spray level.

To avoid impingement of high oxygen-content gases on the furnace walls, there should be a minimum distance between the closest air jets and furnace wall parallel with, and adjacent to the outermost jets at a given elevation, say between the side wall and the nearest ports in the front and rear walls of the furnace. The minimum distance from the side wall should be determined by the spread pattern of the jet stream, and the decay of the centreline oxygen concentration. The size, velocity, and orientation of each jet should be such that impingement on the opposing wall by gas having a high oxygen concentration is avoided. Furthermore, if large ports are used, each port should have a damper.

Figure 6A:
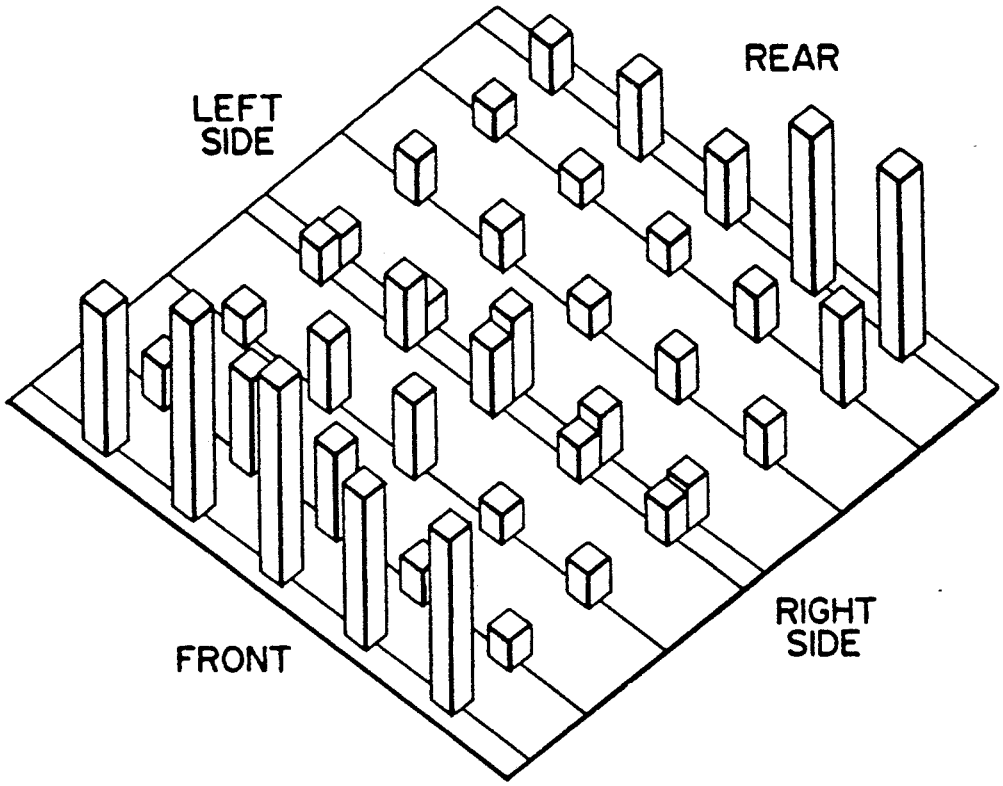
Figure 6B:
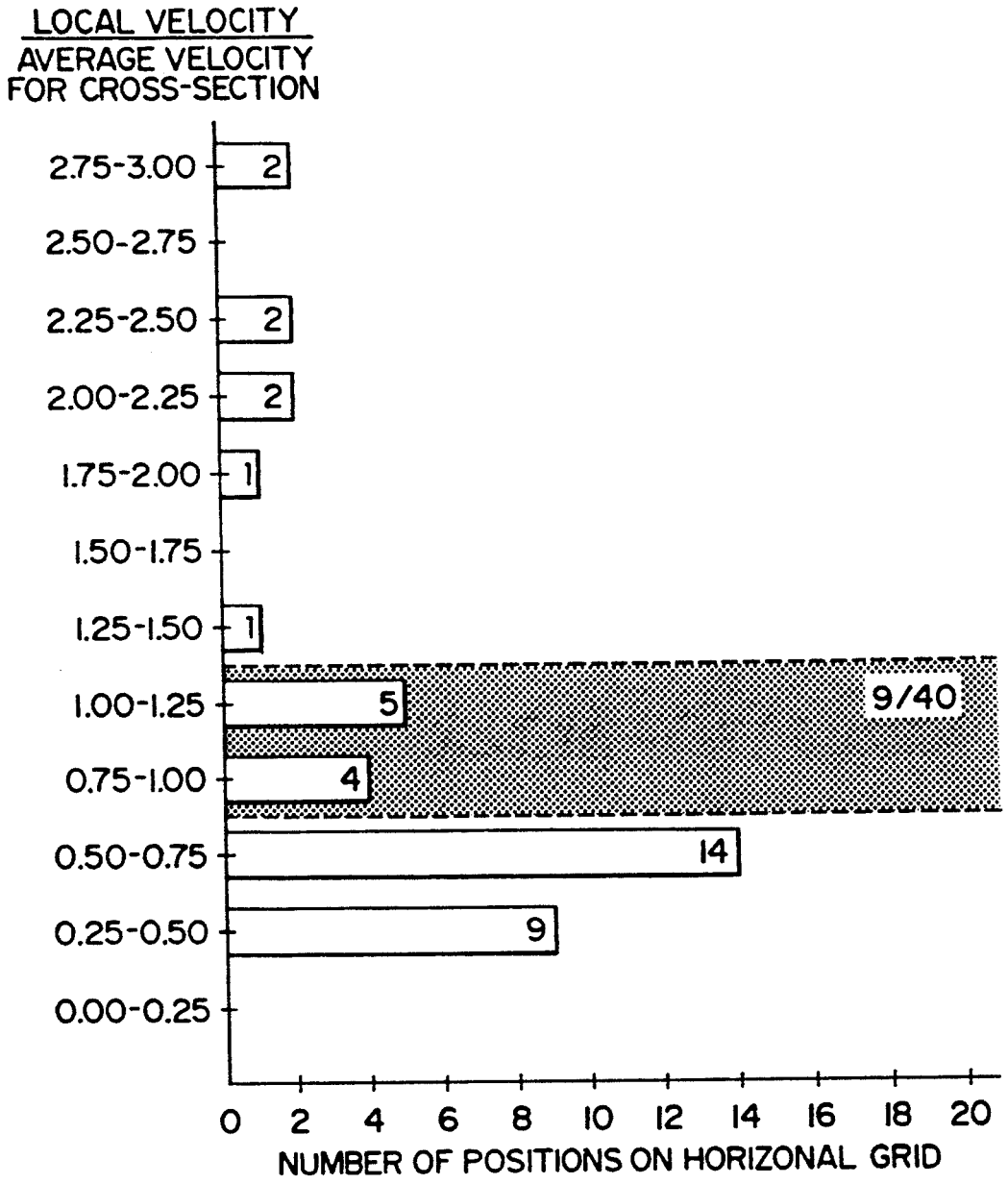

FIG. 6*a* illustrates air velocity measurements on a horizontal grid at the liquor spray level in the physical flow model, with an added second level of air below the liquor spray level, operated with secondary jets originating from the front and rear walls in fully interlaced (unopposed) fashion. FIG. 6*b* illustrates a graphical depiction of measurements of air velocity extremes distribution at the liquor spray level of the 1/12th scale physical flow model, with an added second level of air below the liquor spray level, operated with the secondary jets originating from the front and rear walls, in fully interlaced (unopposed) fashion. FIGS. 6*a* and 6*b* summarize the air velocity profile measured in a 1/12 scale physical flow model at the liquor spray level with an added second level of air below the liquor spray level operating with unopposed secondary jets from the front and rear walls in a fully interlaced fashion. Comparison of FIGS. 3*a* and 3*b* with 6*a* and 6*b* indicates that the chimney flow pattern of the traditional approach was broken, but there is little improvement in the uniformity of the velocities on the furnace horizontal cross-sectional area at the liquor spray level because, with the fully interlaced arrangement, there were high upwards velocities beside the front and rear walls. It was determined that the unopposed jets were sweeping up the opposite walls. The same general pattern results with unopposed fully interlacing jets originating from the two side walls only.

Operation with fully interlaced jets has the disadvantage that the ports need to be properly designed and operated carefully to minimize the impact of having the jets sweeping up the opposite walls with high velocities. Further, as the boiler load changes, or the amount of air being introduced through the ports is altered, the degree of interlacing changes.

Partial Interlacing (Unequally Opposed Jets)

The concept of partial interlacing is claimed by the inventors. The inventors believe that a key to improving the manner and efficiency in which the combustion air is injected into the furnace is to minimize interference between the jets, while avoiding high velocities adjacent to the furnace walls and avoiding consequent impingement of high oxygen-content gas on the furnace walls. The interference of the jet streams with the liquor spray is also of some concern. Local velocity extremes can be reduced by using low initial jet velocities by using air ports as large as possible. By avoiding interference between the air jet streams themselves, detrimental entrainment of liquor spray particles is further reduced.

While full air jet stream interlacing, using unopposed jets, provides an improvement over completely opposed jets in reducing jet interference, it is clear that complete jet stream interlacing has the disadvantage that it reduces the number of sites for air inlet ports on a given furnace wall at a given elevation. Thus, to enable the required quantity of air to be injected into the furnace at a given air level, either larger ports, or higher air velocities from the ports are necessary. For the air introduced above the liquor sprayers, where the quantity of introduced air is not large, reduction in the number of entry sites is not a problem and complete interlacing is acceptable at that level.

Figure 7:
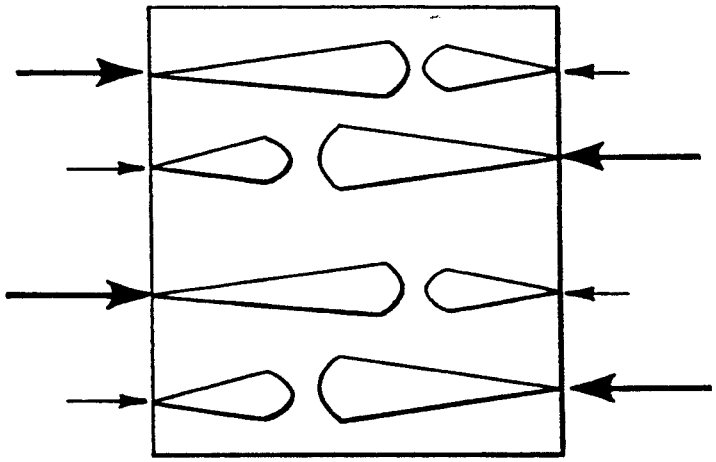

At air entry locations below the liquor gun level, however, the necessary large size of the ports and/or high port discharge velocities becomes a problem, especially since the streams from big ports tend to sweep up the opposite walls of the furnace with high velocity. The inventors have overcome this problem by inventing a partial interlacing pattern, using unequally opposed jets (i.e. opposed jets of unequal size), as illustrated in FIG. 7. With this pattern, a larger jet originating from one furnace wall is opposed in an alternating fashion by a smaller jet originating from the opposite furnace wall. This pattern allows more total port area at a given air level and the jets issuing from the small ports oppose and inhibit the jet streams from the large ports from sweeping the opposite furnace wall. Where the stream from the bigger jet meets the stream from the smaller jet, the jets rise, forming a small updraft. However, each updraft is a localized updraft without a significant re-circulation pattern. Further, because the small jet does not penetrate as far into the furnace as the large jet, the updraft created by the collision of the small and large jets from opposing walls is closer to the wall from which the smaller jet is issuing. Considering the proposed pattern of alternating small and large jets issuing from each wall, a series of small updrafts is created. Relative to each wall, these small updrafts are alternately close to the source of each small jet, then distant from the source of each large jet, across the width of the wall. In plan view, the partially interlaced jets create a staggered pattern of small updrafts rather than a large detrimental central updraft with an inherent and significant recirculation pattern.

A large jet, partially opposed by a smaller jet, can be created in several ways:

1. Use of a larger port, opposite a smaller port, with the same air pressure behind each port.

2. Use of a group of adjacent larger ports, opposite a group of a similar number of adjacent smaller ports, with the same air pressure behind all ports. The individual jets from the groups of large and small ports, combine to form single large and small jets respectively.

3. Use of a group of ports of the same size with the same air pressure behind the ports, the larger jet being formed with a group of a larger number of ports than the smaller jet. For example, there could be two adjacent ports opposite a single port, or three adjacent ports opposite two adjacent ports, etc. Again, the individual jets from each group of ports, combine to form a single jet.

4. Use of two opposing ports of the same size, but creating a higher pressure behind one of the ports to obtain more flow and hence a larger jet than from the opposing port.

5. Use of two groups of opposing ports, with about the same number of ports in each group, and all the ports about the same size, but creating a higher pressure behind one of the groups of ports to obtain more flow, and hence a larger jet formed by the combination of the individual high-pressure jets, than the combined jet from the opposing group of low-pressure ports.

Basically, a large jet partially opposed by a small jet, can be created by either a greater total port area on one wall, opposite a smaller total port area on the opposite wall, all ports having the same air pressure behind them, or similar total port area on the opposing walls, with a higher pressure behind the ports on the one wall compared to the opposing wall.

A physical flow model (1/12 scale) of a traditional Combustion Engineering-type recovery boiler was constructed and operated to test the inventors' theories. The model was operated with both water and air as the working fluid. With water as the working fluid, polystyrene pellets were introduced into the jet streams to enable the jet stream patterns to be seen and to provide qualitative impressions. With air as the working fluid, quantitative measurements were made.

Figure 8A:
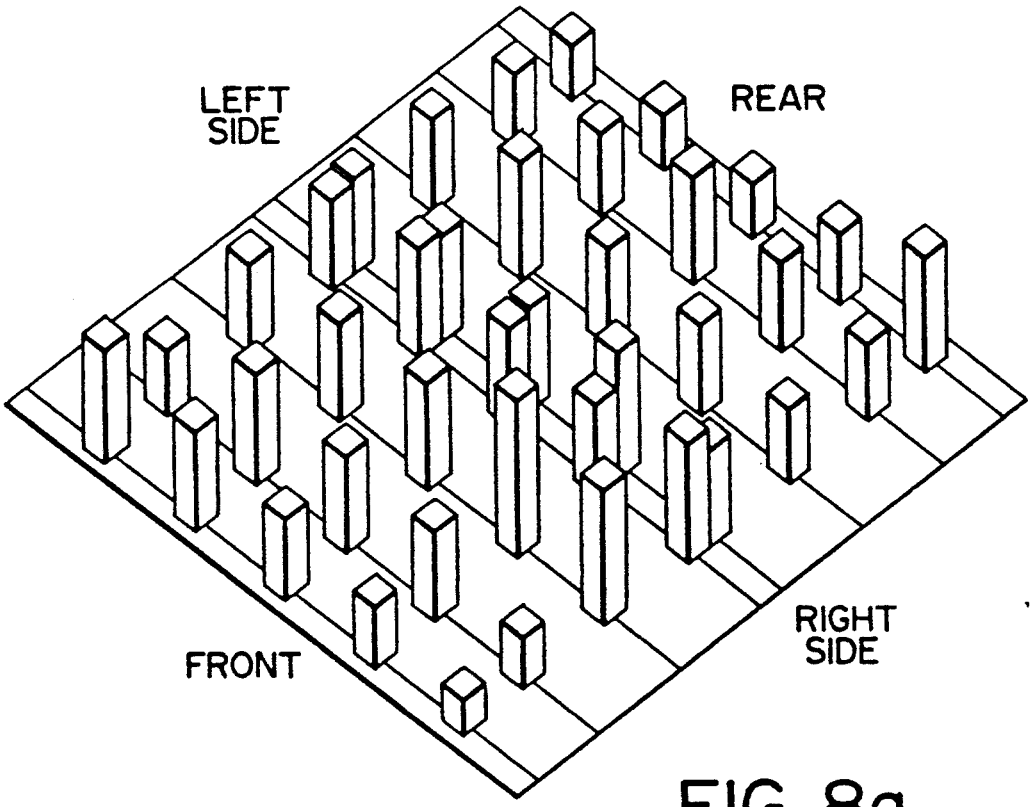
Figure 8B:
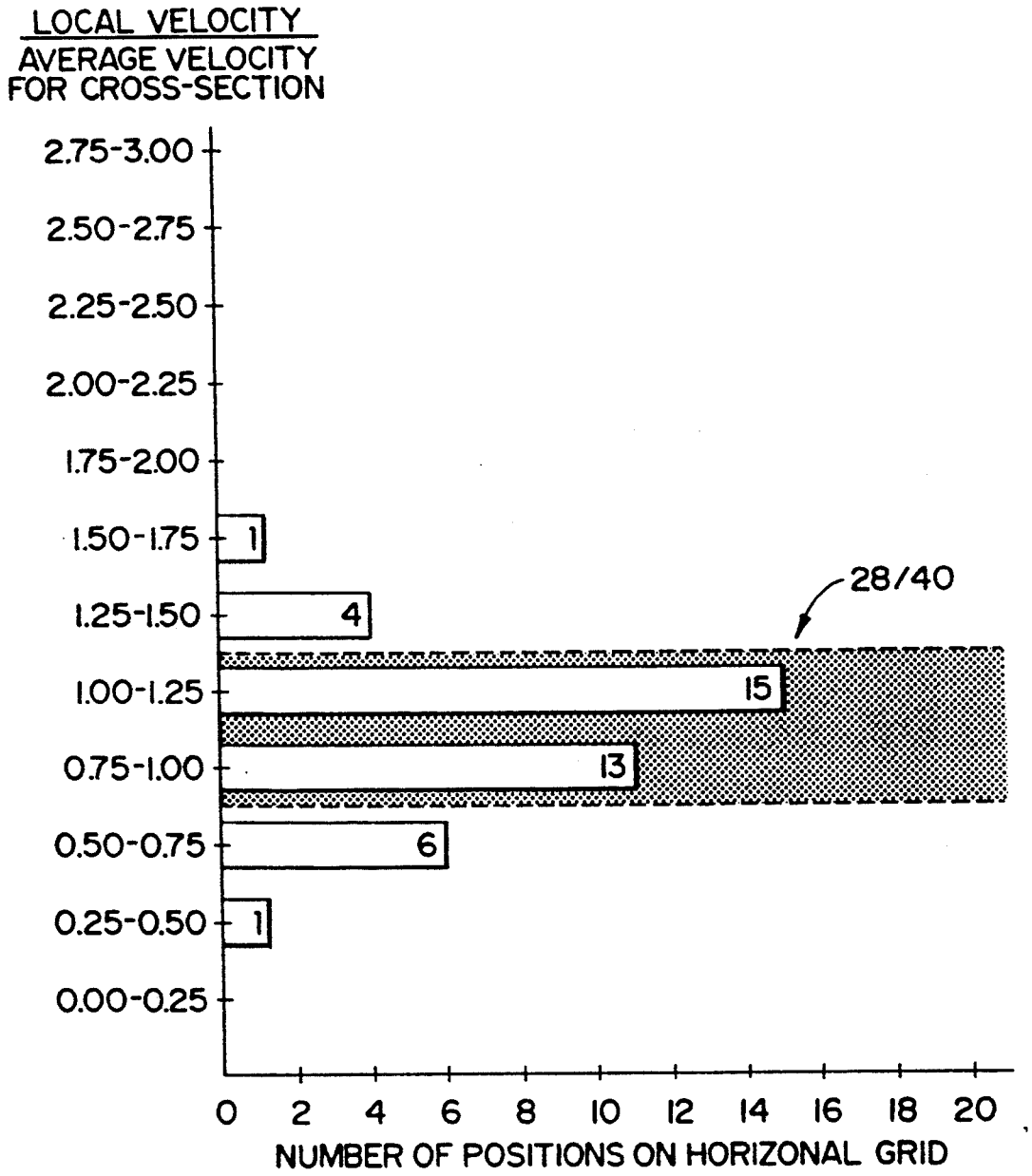

FIG. 8*a* illustrates air velocity measurements on a horizontal grid at the liquor spray level in the physical flow model, with an added level of secondary air below the liquor spray, operated with secondary jets originating from the front and rear walls in a partially interlaced fashion, using unequally opposed jets. FIG. 8*b* illustrates a graphical depiction of measurements of air velocity extremes distribution at the liquor spray level in the 1/12th scale physical flow model with an added level of secondary air below the liquor spray, operated with secondary jets originating from the front and rear walls in a partially interlaced fashion, using unequally opposed jets. FIGS. 8*a* and 8*b* summarize the air velocity profile measured in the physical model at the liquor spray level with an added second level of the air below the liquor spray level, operating with unequally opposed secondary jets originating from the front and rear walls in a partially interlaced fashion. Comparison of FIGS. 8*a* and 8*b* with FIGS. 3*a* and 3*b* indicates that the chimney flow pattern of the traditional approach was broken and there was a substantial improvement in the uniformity of the velocity profile with partial interlacing. Except for one high reading near the right side close to the front, the velocity profile with partial interlacing is almost flat. Comparison of FIGS. 8*a* and 8*b* with FIGS. 6*a* and 6*b* indicates that partial interlacing is superior to full interlacing in providing a uniform velocity profile at the liquor spray level.

With the full interlacing jet pattern shown in FIG. 5 and the partial interlacing jet pattern in FIG. 7, there is no disadvantageous main central updraft core. Likewise, there is no detrimental recirculating pattern, as is the case with the arrangements depicted in FIGS. 1 and 3. In particular, partial interlacing reduces velocity extremes in the furnace horizontal cross-section area in the lower furnace below the liquor spray level, relative to the conventional arrangements depicted in FIGS. 1 and 3, and relative to the full interlacing arrangement in FIG. 5.

Figure 9A:
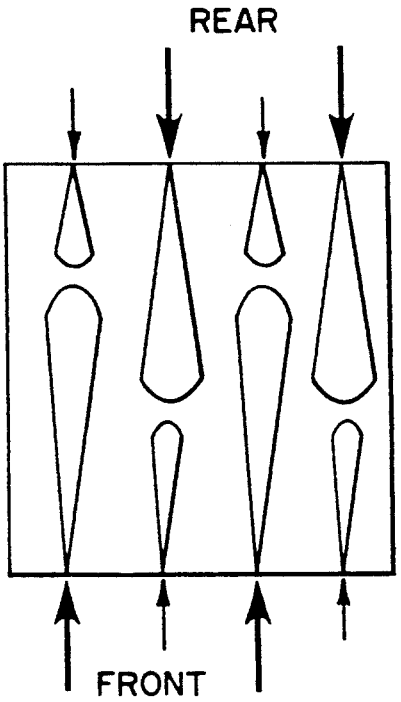
Figure 9B:
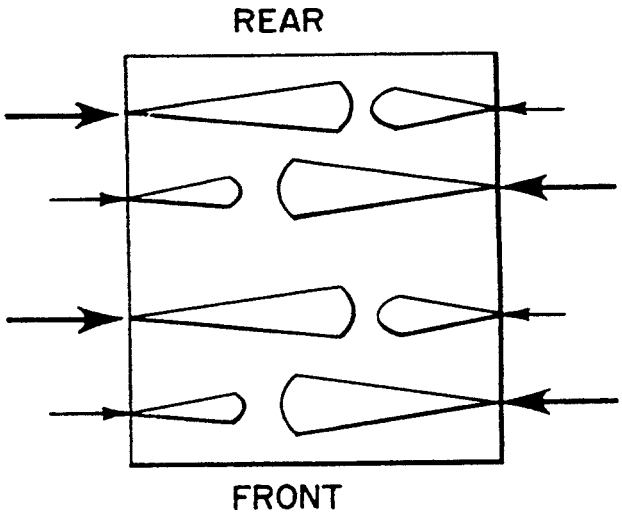

It is evident that with the partial interlacing concept of the invention, using only two opposite walls (rather than all four walls) the amount of air that can be introduced into the furnace at a given air level is limited, particularly if the port discharge velocity is to be kept low. The inventors have determined that this potential handicap can be overcome by utilizing several air levels, for example, two, three or four, below the liquor spray level, and another air level above the liquor sprayers. With these different air levels, it is preferable that the opposing furnace walls used for introduction of air at each level are alternated as shown in FIG. 9. FIG. 9*a* illustrates a plan view of the jet stream pattern in a boiler furnace with partially interlaced jet streams at a lower air level originating from one pair of opposing walls. FIG. 9*b* illustrates a plan view of the jet stream pattern in a boiler furnace with partially interlaced jet streams at an adjacent upper air level originating from the other pair of opposing walls (compared to FIG. 9*a*). As shown, the jets on one elevation are positioned, for example, on the front and rear walls of the furnace while the jets on the next adjacent elevation are positioned on the respective side walls of the furnace, and so on, for as many levels as are used. Furthermore, interference between two air levels relatively close together vertically can be reduced by orienting the ports in the lower level, downwardly or horizontally, while having the upper level oriented horizontally or slightly upwards. The final jet orientation arrangement is selected to provide as equal gas temperatures as possible across the horizontal cross-section of the furnace of the boiler. This objective is aided by placing the uppermost layer of ports above the liquor spray level, in the front and rear walls of the furnace, rather than in the side walls.

Fridley and Barsin, referred to earlier, disclose alternating the opposing furnace walls used for introducing secondary air and tertiary air, in a boiler having three air levels, two levels below the liquor spray level and a third level above the liquor spray level. At both the secondary and tertiary levels, they applied a fully interlaced pattern using unopposed air jets, using the front wall and rear wall at the secondary level, and the two side walls at the tertiary level. Their disclosure is limited to fully interlaced unopposed jets.

With total interlacing air jets as shown in FIG. 5, or partial interlacing as shown in FIG. 7, it is important that no air is introduced at right angles to the interlacing pattern at that elevation. If air is introduced from ports in a third wall, or a third and fourth wall at the same elevation, then there is a tendency to form an adverse central updraft core. The adverse effects of air introduced at right angles to the interlacing pattern may be unavoidable on an existing boiler, where some air continues to leak through the dampers controlling the air flow through the ports at right angles to the interlacing pattern, as shown in FIGS. 13, 14 and 17.

The jets should preferably be introduced at several elevations in the furnace, using one of the two following methods at a given elevation:

1. A relatively small number of large ports, located in two opposing furnace walls, preferably with the jets partially interlacing (or, less preferably, completely interlacing as is the pattern of the air introduced above the liquor spray level).

Figure 10:
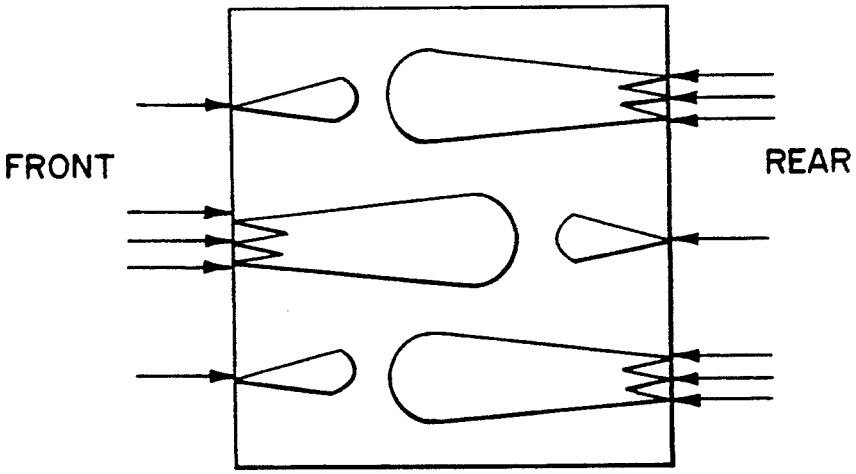
Figure 11A:
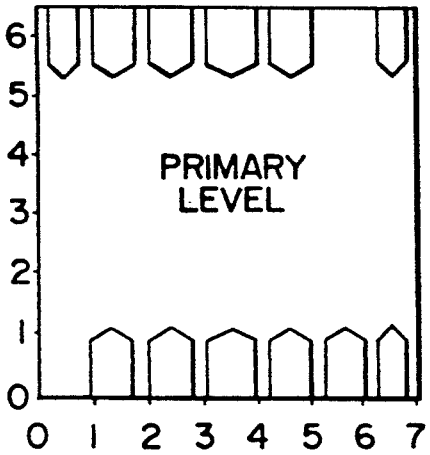
Figure 11B:
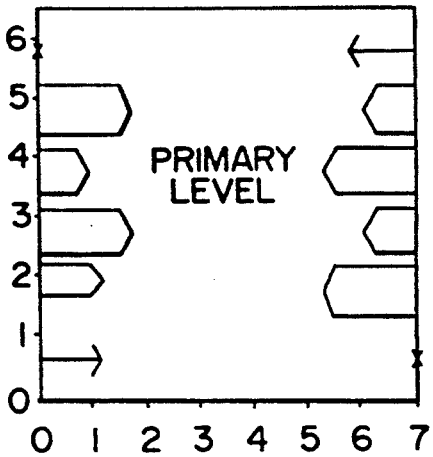
Figure 11C:
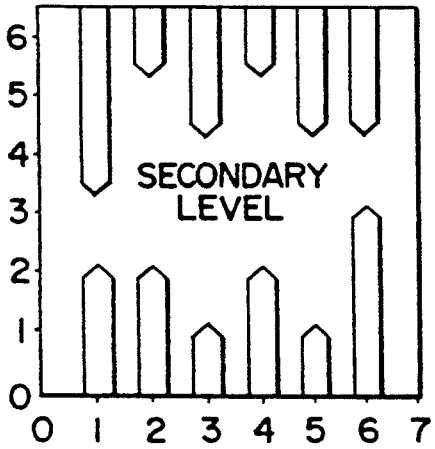
Figure 11D:
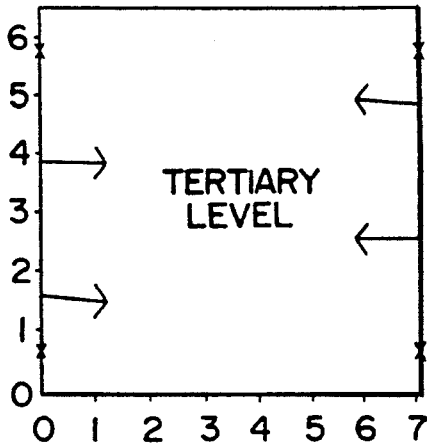

2. A large number of smaller ports, rectangular in shape, arranged in groups forming a register effect so that the jets in one group merge together a short distance from the wall to form one larger jet, as shown in FIG. 10. In this case, three smaller jets combine to form a larger jet. Similarly, a combination of two jets may be used or a combination of any other number of jets. In this case, the small jet is formed by one jet. Similary, it may be formed by the combination of two or more smaller jets. These groups would be located on two opposing furnace walls, with the large compound jets completely or partially interlacing.

It is evident that the problem with gas velocity extremes and detrimental central updraft in recovery boilers as presently constructed, originates at the primary air level and becomes accentuated at each successive higher air entry level. To address these problems utilizing the design concepts of the invention, two basic approaches can be taken.

One approach is to completely eliminate or minimize the source of the problem. This approach involves using the jet stream patterns illustrated in FIGS. 5, 7, 9 and/or 10 at all air levels, especially the primary level. This approach is expensive, however, and is applicable mainly to the construction of new boilers.

A second, less costly approach, in particular on existing boilers, involves minimizing modifications at the primary air level. With this approach, an updraft is permitted to develop at the primary level but the updraft is then corrected or minimized at the secondary and tertiary air levels. First, the updraft created at the primary level can be enlarged and the velocity extremes reduced, as noted above, by admitting the air from two opposed walls only, by closing, to the fullest extent possible, the primary ports on the other two walls. Then the design patterns shown in FIGS. 5, 7, 9 and/or 10 are applied at the secondary level. In a sense, this corrective approach can be regarded as putting a blanket over the upflowing gases, and in so doing, evening out the gas flow to minimize the velocity extremes. The first approach is preferred if expense is not a problem, or circumstances permit, although some success can be achieved with the second approach. As a general rule, the first approach should produce more satisfactory and more extensive results.

A number of considerations should be taken into account in applying the design concepts and patterns of the partial interlacing (unequally opposed jets) invention to each elevation in the boiler.

A: Primary Air Level (Immediately above the char bed): Ideally, the primary air level should be operated using high-velocity partially interlaced jets from two opposed walls, shown in FIGS. 7, 9 and 10. Alternatively, the two-wall primary air concept shown in FIGS. 12 through 17 can be used, especially in existing boilers.

B. Secondary Air Level (Approximately one meter above the primary air level): The partial interlacing arrangement shown in FIGS. 7, 9, 10 and 17 is particularly useful for the secondary air level. This arrangement can be used in both new and retrofit situations.

C. Liquor Spray Level (Above the primary and secondary air levels): Air that infiltrates into the ports for the liquor gun nozzles enters the boiler with low velocity because of the low difference in pressure between the outside and the inside of the furnace. The streams from these gun ports therefore have little momentum and are readily deflected upwards and may thus decrease the boiler efficiency by increasing the excess air, rather than contributing to the combustion in the lower furnace. Because of this fact, the size of the liquor gun ports should be minimized. A removable device can be used to blank off the open area around the gun.

D. Tertiary Air Level (Above the liquor guns): In conventional boilers with two full levels of air entry below the liquor spray level and one level of air above the liquor spray level, five to twenty percent of the total combustion air is introduced into the furnace at the tertiary level, some distance above the liquor guns. The total combustion air quantity that is introduced into the boiler is, however, only 105 to 110 percent of the stoichiometric air quantity. Therefore, the combustion cannot be completed until the tertiary air is added. The basic thrust of the proposed system of the invention is contrary, namely to complete the combustion at as low an elevation in the furnace as possible. In boiler operation, there is some volatilization of hydrogen sulphide and organic combustibles, such as terpenes, from the liquor spray while the liquor spray travels across and down into the furnace. For efficient operation, these combustibles must be burned. Also, furnace gases coming from below the liquor gun level contain some combustibles such as CO and $H_2S$. There can also be some oxygen in the furnace gases coming from below the liquor gun level because mixing may not be ideal at lower elevations in the furnace. If all of the combustion air ultimately required in the efficient operation of the boiler has been added below the liquor guns, then additional mixing, rather than more air, is all that is required at the tertiary level. Jets are effective as mixing devices, so the requisite additional mixing can be provided by the introduction of any suitable fluid such as air, steam or clean flue gas (for example, from the outlet of the precipitator of the system) through suitably designed ports at the tertiary level. Where energy efficiency is important, re-cycled flue gas is the best option. Where either increased capacity or decreased odorous emissions are the most important, unheated ambient air is the best option. The design concepts illustrated in FIG. 5, depicting complete interlacing with unopposed jets, can be used at the tertiary level. The mixing and penetration of these jets can be improved by angling them downwardly (e.g. 30°) into the upflowing gases. Also, pointing the jets downwardly delivers the air to a lower effective elevation in the furnace, thereby helping to complete the combustion at as low an elevation in the furnace as possible. However, when directing the tertiary jets downwards, care must be taken that they do not interfere with the liquor spray.

Prototype Design

FIG. 11 illustrates, in composite, three elevations in an actual boiler employing the patterns and design concepts discussed above in relation to FIGS. 7, 9 and 10. FIGS. 11*a*, 11*b*, 11*c* and 11*d* illustrate the air port layout utilizing partially and totally interlacing jet streams in one recovery boiler by showing two plan section views of the primary elevation in the furnace, a plan view of the secondary level and a plan view of the tertiary level. At the primary and secondary levels, most of the jets are formed by the combination of smaller jets from closely grouped ports. Jet locations and relative air jet stream flows are depicted by means of pointed block arrows at the primary and secondary levels and pointed arrows at the tertiary level. For clarity, the primary level is broken into two depictions. At the secondary level, the partially interlaced pattern was slightly modified by the addition of one extra port to each of the four groups of ports in the corners to provide more air adjacent to the sidewalls.

FIG. 12 illustrates two wall opposed jets at the primary level. FIG. 13 illustrates a variation of two-wall opposed jets at the primary level, involving small jets from a third wall. These small jets would typically be issuing from the partially closed, or fully closed and leaking, air ports on an existing boiler. FIG. 14 illustrates a variation of two-wall opposed jets at the primary level involving small jets from third and fourth walls. Similarly, these small jets would typically be issuing from the partially closed, or fully closed and leaking, air ports on an existing boiler. FIG. 15 illustrates two-wall opposed jets at the primary level and two-wall opposed jets at the secondary level where the same two opposing walls are used at both air levels. FIG. 16 illustrates a variation of two-wall opposed jets at the primary level involving small jets from the third and fourth walls and a variation of two-wall opposed jets of the secondary level involving small jets from the third and fourth walls. The dominant walls for air flow at the secondary level are the same as at the primary level. FIG. 17 illustrates two-wall primary air and partial interlacing of the secondary air jets with a small amount of air leaking through the existing ports on the other two walls at both air levels.

As will be apparent to those skilled in the art, in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of introducing primary air at the lowest airflow elevation into a kraft recovery boiler furnace comprising:

(a) introducing air into the furnace at the lowest air flow elevation by means of a first set of large jets originating from a first wall of the interior of the furnace;

(b) introducing air into the furnace by means of a second set of large jets originating from a second wall of the interior of the furnace opposite the first wall and substantially at the same elevation as the first set of jets; and (c) introducing air into the furnace by means of a third set of small jets originating from a third wall of the interior of the furnace between the first wall and the second wall, at substantially the same elevation as the first and second sets of jets.

2. A method according to claim 1 wherein air is introduced into the furnace using large jets originating from the first and second opposing walls with approximately the same air flow rate from each wall, and air is introduced into the furnace using small jets originating from the third wall of the furnace at a flow rate lower than the flow rate of air in the jets originating from the first and second walls.

3. A method of introducing primary air at the lowest airflow elevation into a kraft recovery boiler furnace comprising:

(a) introducing air into the furnace at the lowest air flow elevation by means of a first set of large jets originating from a first wall of the interior of the furnace;

(b) introducing air into the furnace by means of a second set of large jets originating from a second wall of the interior of the furnace opposite the first wall and substantially at the same elevation as the first set of jets;

(c) introducing air into the furnace by means of a third set of small jets originating from a third wall of the interior of the furnace between the first wall and the second wall, at substantially the same elevation as the first and second sets of jets; and (d) introducing air into the furnace by means of a fourth set of small jets originating from a fourth wall of the interior of the furnace between the first wall and the second wall, opposite the third wall, at substantially the same elevation as the first, second and third sets of jets.

4. A method according to claim 3 wherein air is introduced into the furnace using large jets originating from the first and second opposed walls with approximately the same airflow rate from each wall, and air is introduced into the furnace using small jets originating from the third and fourth opposing wall of the furnace with flow rates from the third and fourth walls lower than the flow rate of air in the jets originating from the first and second walls.

5. A method according to claim 2 wherein:

(a) secondary air is introduced using another first set of jets located at an elevation higher than the lowest elevation on said first wall of the interior of the boiler furnace;

(b) secondary air is introduced using another second set of jets located on said second wall of the interior of the boiler furnace opposed to said first wall substantially at said elevation higher than the lowest elevation; and (c) substantially no secondary air being introduced through the remaining walls substantially at said elevation higher than the lowest elevation.

6. A method according to claim 2 wherein:

(a) secondary air is introduced using another first set of jets located at an elevation higher than the lowest elevation on said first wall of the interior of the furnace;

(b) secondary air is introduced using another second set of jets located on said second wall of the interior of the boiler furnace opposed to said first wall substantially at said elevation higher than the lowest elevation with approximately the same flow rate of secondary air from the said first and second walls; and (c) secondary air is introduced substantially at said elevation higher than the lowest elevation using sets of jets located on said third and fourth walls of the interior of the furnace, between the first and second walls, the flow of secondary air through the third and fourth walls being less than the flow of secondary air through the first and second walls.

7. A method according to claim 4 wherein:

(a) secondary air is introduced using another first set of jets located at an elevation higher than the lowest elevation on said first wall of the interior of the boiler furnace;

(b) secondary air is introduced using another second set of jets located on said second wall of the interior of the boiler furnace opposed to said first wall substantially at said elevation higher than the lowest elevation; and (c) substantially no secondary air being introduced through the remaining walls substantially at said elevation higher than the lowest elevation.

8. A method according to claim 4 wherein:

(a) secondary air is introduced using another first set of jets located at an elevation higher than the lowest elevation on said first wall of the interior of the furnace;

(b) secondary air is introduced using another second set of jets located on said second wall of the interior of the boiler furnace opposed to said first wall substantially at said elevation higher than the lowest elevation with approximately the same flow rate of secondary air from the said first and second walls; and (c) secondary air is introduced substantially at said elevation higher than the lowest elevation using sets of jets located on said third and fourth walls of the interior of the furnace, between the first and second walls, the flow of secondary air through the third and fourth walls being less than the flow of secondary air through the first and second walls.

9. A method according to claim 4 wherein the small and large jets originate from corresponding single small and large ports located in the respective furnace walls.

10. A method according to claim 4 wherein each small jet is formed by the combination of jets originating from a first group of closely spaced small ports located in the respective furnace wall and each large jet is formed by the combination of jets originating from a second group of closely spaced large ports of similar number to the first group located in the respective furnace wall.

11. A method according to claim 4 wherein each small jet is formed by a combination of jets originating from a first group of closely spaced small ports located in the respective furnace wall and each large jet is formed by a combination of jets originating from a second group of closely spaced large ports of a different number than the first group located in the respective furnace wall.

12. A method according to claim 4 wherein the small and large jets originate from ports that are of similar size and each large jet is formed by a combination of jets originating from a larger group of closely spaced ports than does each of the small jets.

13. A method according to claim 4 wherein the small and large jets originate from ports that are of similar size and each large jet is formed by a combination of jets originating from a pair of closely spaced ports and each small jet originates from a single port.

14. A method according to claim 4 wherein the large and small jets originate from single ports of similar size and the large jets are created by air pressure at a higher level behind the respective ports compared with the air pressure behind the respective ports used to create the small jets.

15. A method according to claim 4 wherein each jet is formed by a combination of jets originating from a group of closely spaced ports similar in size and number and the large jets are created by air pressure at a higher level behind the ports compared with the air pressure behind the ports used to create the small jets.

16. A method according to claim 4 wherein each jet is formed by a combination of jets issuing from a cluster of closely spaced ports with some of the ports in each cluster being at one elevation and the other ports at one or more slightly different elevations.

17. A kraft recovery boiler which utilizes injected air comprising:

(a) a furnace chamber having four walls;

(b) a first set of large ports located at the lowest elevation on a first wall of the interior of the furnace;

(c) a second set of ports, having a size similar to the ports in said first set, located at the lowest elevation on a second wall of the interior of the furnace opposite the first wall;

(d) a third set of small ports located at the lowest elevation on a third wall of the interior of the furnace, between the first and second wall; and (e) no ports located at the lowest elevation on a fourth wall of the interior of the furnace opposite to the third wall.

18. A kraft recovery boiler furnace which utilizes injected air comprising:

(a) a furnace chamber having four walls;

(b) a first set of large ports located at the lowest elevation on a first wall of the interior of the furnace;

(c) a second set of ports of similar size to the first set located at the lowest elevation on a second wall of the interior of the furnace opposite the first wall;

(d) a third set of small ports located at the lowest elevation on a third wall of the interior of the furnace, between the first and second wall; and (e) a fourth set of small ports of similar size to the third set located at the lowest elevation on a fourth wall of the interior of the furnace opposite the third wall.

19. A kraft recovery boiler furnace which utilizes injected air comprising:

(a) a furnace chamber having four walls;

(b) a first set of ports located at the lowest elevation on a first wall of the interior of the furnace;

(c) a second set of ports of similar size to the first set located at the lowest elevation on a second wall of the interior of the furnace opposite the first wall;

(d) a third set of ports of similar size to the first set located at the lowest elevation on a third wall of the interior of the furnace, between the first and second wall;

(e) a fourth set of ports of similar size to the first set located at the lowest elevation on a fourth wall of the interior of the furnace opposite to the third wall; and (f) a set of devices associated with the ports on all four walls, for restricting the flow of air in the ports, said devices being operated such that the flow of air through the third and fourth sets of ports is less than the flow of air through the first and second sets of ports.

20. A kraft recovery boiler furnace which utilizes injected air comprising:

(a) a furnace chamber having four walls;

(b) a first set of ports located at the lowest elevation on a first wall of the interior of the furnace;

(c) a second set of ports of similar size to the first set located at the lowest elevation on a second wall of the interior of the furnace opposite the first wall;

(d) a third set of ports of similar size to the first set located at the lowest elevation on a third wall of the interior of the furnace, between the first and second wall;

(e) a fourth set of ports of similar size to the first set located at the lowest elevation on a fourth wall of the interior of the furnace opposite to the third wall; and (f) a set of devices associated with the ports on all four walls, for restricting the flow of air in the ports, said devices being operated such that the flow of air through the third set of ports is somewhat less than the flow of air through the first and second sets of ports and the flow of air through the fourth sets of ports is considerably less than the flow of air through the first and second sets of ports.

21. A kraft recovery boiler furnace which utilizes injected air comprising:

(a) a furnace chamber having four walls;

(b) a first set of ports located at the lowest elevation on a first wall of the interior of the furnace;

(c) a second set of ports of similar size to the first set located at the lowest elevation on a second wall of the interior of the furnace opposite the first wall;

(d) a third set of ports of similar size to the first set located at the lowest elevation on a third wall of the interior of the furnace, between the first and second wall;

(e) a fourth set of ports of similar size to the first set located at the lowest elevation on a fourth wall of the interior of the furnace opposite the third wall; and (f) a set of devices associated with the ports on all four walls, for restricting the flow of air in the ports, said devices in the third and fourth walls being operated such that the flow of air through the third and fourth sets of ports is considerably less than the flow of air to the first and second sets of ports.

22. A kraft recovery boiler furnace according to claim 19 further including:

(g) another first set of ports is located on said first wall of the interior of the furnace at an elevation above the lowest elevation;

(h) another second set of ports is located on said second wall of the interior of the furnace at an elevation above the lowest elevation and at substantially the same elevation as said another first set of ports; and (i) no ports being located on the third and fourth walls at substantially the same elevation where said another first set of ports and said another second set of ports are located.

23. A kraft recovery boiler furnace according to claim 21 further including:

(g) another first set of ports is located on said first wall of the interior of the furnace at an elevation above the lowest elevation;

(h) another set of second ports is located on said second wall of the interior of the furnace at an elevation above the lowest elevation and at substantially the same elevation as said another first set of ports; and (i) no ports being located on the third and fourth walls at substantially the elevation where said another first set of ports and said another second set of ports are located.

24. A kraft recovery boiler according to claim 19 further including:

(g) sets of ports are located on all four walls of the interior of the furnace at an elevation above the lowest elevation; and (h) devices are associated with the ports on all four walls substantially at an elevation above said lowest elevation, for restricting the flow of air in the ports at said elevation above the lowest elevation, said devices being operated such that the flow of air through the third and fourth sets of ports is less than the flow of air through the first and second sets of ports.

25. A kraft recovery boiler furnace according to claim 21 further including:

(g) sets of ports are located on all four walls of the interior of the furnace at an elevation above the lowest elevation; and (h) devices are associated with the ports on all four walls substantially at an elevation above said lowest elevation, for restricting the flow of air in the ports at said elevation above the lowest elevation, said devices being operated such that the flow of air through the third and fourth sets of ports is less than the flow of air through the first and second sets of ports.

26. A kraft recovery boiler furnace according to claim 20 further including:

(g) sets of ports are located on all four walls of the interior of the furnace at an elevation above the lowest elevation; and (h) devices are associated with the ports on all four walls substantially at said elevation above the lowest elevation, for restricting the flow of air in the ports at said elevation above the lowest elevation, said devices being operated such that the flow of air through the third and fourth sets of ports is considerably less than the flow of air through the first and second sets of ports.

27. A kraft recovery boiler furnace according to claim 21 further including:

(g) sets of ports are located on all four walls of the interior of the furnace at an elevation above the lowest elevation; and (h) devices are associated with the ports on all four walls substantially at said elevation above the lowest elevation, for restricting the flow of air in the ports at said elevation above the lowest elevation, said devices being operated such that the flow of air through the third and fourth sets of ports is considerably less than the flow of air through the first and second sets of ports.

28. A method of introducing air at any elevation into a boiler furnace comprising:

(a) introducing air into the furnace by means of a first set of one or more small jets and one or more large jets originating from one wall of the interior of the furnace;

(b) introducing air into the furnace by means of a second set of one or more small jets and one or more large jets originating from a second wall of the interior of the furnace opposite the first wall and substantially at the same elevation as the first set of jets;

(c) introducing air into the furnace where the positions of the jets in the first set are arranged so that a small jet originating from the first wall substantially opposes a large jet originating from the opposite wall and a large jet originating from the first wall substantially opposes a small jet originating from the opposite wall.

29. A method according to claim 25 wherein the small and large jets of the first set alternate with one another and the small and large jets of the second set alternate with one another.

30. A method according to claim 29 wherein the small and large jets originate from corresponding small and large ports located in the furnace wall.

31. A method according to claim 29 wherein each small jet is formed by a combination of jets from a first group of closely spaced small ports located in the furnace wall and each large jet is formed by a combination of jets from a second group of closely spaced large ports of similar number to the first group located in the furnace wall.

32. A method according to claim 29 wherein each small jet is formed by a combination of jets from a first group of closely spaced small ports located in the furnace wall and each large jet is formed by a combination of jets from a second group of closely spaced large ports of a different number than the first group located in the furnace wall.

33. A method according to claim 29 wherein all the ports are of similar size and each jet is formed by a combination of jets from a group of closely spaced ports and each large jet is formed by a larger group of closely spaced ports than the group forming the small jets.

34. A method according to claim 29 wherein all the ports are of similar size and each of the large jets is formed by a combination of jets from a pair of closely spaced ports and each of the small jets originates from a single port.

35. A method according to claim 34 wherein some or all of the area of the single port is substantially opposite to at least some of the area defined by the pair of ports.

36. A method according to claim 35 wherein some or all of the area of the single port is opposite the area defined by the pair of ports.

37. A method according to claim 31 wherein each jet issues from a cluster of closely spaced ports with some of the ports in each cluster being at one elevation and the other ports in the cluster at one or more slightly different elevations.

38. A method according to claim 32 wherein each jet issues from a cluster of closely spaced ports with some of the ports in each cluster being at one elevation and the other ports in the cluster at one or more slightly different elevations.

39. A method according to claim 33 wherein each jet issues from a cluster of closely spaced ports with some of the ports in each cluster being at one elevation and the other ports in the cluster at one or more slightly different elevations.

40. A method according to claim 33 wherein the boiler is a kraft recovery boiler.

41. A method according to claim 33 wherein the boiler is a biomass fired boiler.

42. A method according to claim 34 wherein the boiler is a kraft recovery boiler.

43. A method according to claim 35 wherein the boiler is a kraft recovery boiler.

44. A method according to claim 24 wherein the flow of air which is introduced into the furnace at each elevation is such that most of the air is distributed in substantially equal portions through the first and second walls and a small portion of the air is distributed substantially equally through the third and fourth walls.

45. A method according to claim 29 including an arrangement of jets originating from the third and fourth walls of the furnace at substantially the same elevation as the first and second sets of jets, and the air that is introduced to the furnace at said elevation is distributed so that most of the air is distributed in substantially equal portions through the first and second walls, and a small portion of air is distributed substantially equally through the third and fourth walls.

46. A boiler furnace which utilizes injected air comprising:

(a) a furnace chamber;

(b) a first set of similarly sized ports located on one wall of the interior of the furnace; and (c) a second set of ports located on the wall of the interior of the furnace opposite the first wall, said ports in the second set being of size and number similar to the first set of ports, said ports in each set being arranged in large and small groups of closely spaced ports and, wherein groups of a greater number of closely spaced ports on each wall oppose groups of a fewer number of closely spaced ports on the opposite wall.

47. A furnace as defined in claim 46 wherein the groups of greater and fewer number ports in the first set are arranged in an alternating pattern and the groups of greater and fewer number ports in the second set are arranged in an alternating pattern.

48. A furnace according to claim 46 wherein the boiler is a kraft recovery boiler.

49. A furnace according to claim 46 wherein the boiler is a biomass fired boiler.

50. A furnace according to claim 46 wherein the air which is introduced into the furnace is distributed approximately equally between the two opposed walls.

51. A furnace according to claim 44 wherein air ports are included on third and fourth walls at the same elevation as the first and second sets of ports, and the air that is added to the furnace through the ports at said elevation is distributed so that most of the air is distributed in relatively equal portions through the first and second walls, and a small portion of air is introduced in relatively equal portions through the third and fourth walls.

52. A method according to claim 3 wherein air is introduced into the furnace using large jets originating from the first and second walls and small jets originating from the third and fourth opposing walls of the furnace at substantially the same elevation as the first and second sets of jets, and the air that is introduced to the furnace at said elevation is distributed so that a large portion of the air is distributed in substantially equal portions through the first and second walls, and a small portion of the air is distributed in substantially equal portions through the third and fourth walls.

53. A method according to claim 7 wherein the flow of secondary air is distributed approximately equally between the two opposed walls.

54. A method according to claim 52 wherein:

(a) secondary air is introduced using another first set of jets located at a second elevation higher than the lowest elevation on said first wall of the interior of the boiler furnace;

(b) secondary air is introduced using another second set of jets located on said second wall of the interior of the boiler furnace opposed to said first wall at substantially said second elevation higher than the lowest elevation; and (c) the remaining walls having no secondary air being introduced substantially at said second elevation higher than the lowest elevation.

55. A method according to claim 54 wherein the flow of secondary air is distributed approximately equally between the two opposed walls.

56. A method according to claim 52 wherein:

(a) secondary air is introduced using another first set of jets located at a second elevation higher than the lowest elevation on said first wall of the interior of the furnace;

(b) secondary air is introduced using another second set of jets located on said second wall of the interior of the boiler furnace opposed of said first wall at substantially said second elevation higher than the lowest elevation with approximately the same flow rate of secondary air from the first and second walls; and (c) secondary air is introduced substantially at said second elevation higher than the lowest elevation using sets of jets located on said third and fourth walls of the interior of the furnace, between the first and second walls, the flow of secondary air through the third and fourth walls being less than the flow of secondary air through the first and second walls.

57. A method according to claim 52 wherein each large jet is formed by a combination of jets originating from a first group of closely spaced large ports located in the respective furnace wall and each small jet is formed by a combination of jets originating from a second group of closely spaced small ports of similar number to the first group located in the respective furnace wall.

58. A method according to claim 52 wherein each large jet is formed by a combination of jets originating from a first group of closely spaced large ports located in the respective furnace wall and each small jet is formed by a combination of jets originating from a second group of closely spaced small ports of a different number than the first group located in the respective furnace wall.

59. A method according to claim 52 wherein each of the large and small jets is formed by a combination of jets originating from the group of closely spaced ports that are of similar size and each large jet originates from a larger group of closely spaced ports than each of the small jets.

60. A method according to claim 52 wherein the large and small jets originate from ports that are of similar size and each large jet is formed by a combination of jets originating from a pair of closely spaced ports and each small jet originates from a single port.

61. A method according to claim 52 wherein the large and small jets originate from single ports of similar size and the large jets are created by air pressure at a higher level behind the respective ports compared with the air pressure behind the respective ports used to create the small jets.

62. A method according to claim 52 wherein each jet is formed by a combination of jets originating from a group of closely spaced ports similar in size and number and the large jets are created by air pressure at a higher level behind the ports compared with the air pressure behind the ports used to create the small jets.

63. A method according to claim 57 wherein each group of ports is a cluster of closely spaced ports with some of the ports in each cluster being at one elevation and the remaining ports being at one or more different elevations.

64. A method according to claim 34 wherein the boiler is a boimass fired boiler.

65. A method according to claim 35 wherein the boiler is a boimass fired boiler.

* * * * *

UNITED STATES PATENT AND TRADEMARK OFFICE

CERTIFICATE OF CORRECTION

PATENT NO. : 5,305,698

DATED : 26 April, 1994

INVENTOR(S) : Brian R. Blackwell and Colin MacCallum

It is certified that error appears in the above-identified patent and that said Letters Patent is hereby corrected as shown below:

Column 25,
In Claim 29, replace "25" with --28--.

Column 26,
In Claim 51, replace "44" with --46 --.

Signed and Sealed this

Thirty-first Day of January, 1995

*Attest:*

Bruce Lehman

BRUCE LEHMAN

*Attesting Officer*

*Commissioner of Patents and Trademarks*